US008261819B1

(12) United States Patent
Gibbs et al.

(10) Patent No.: US 8,261,819 B1
(45) Date of Patent: Sep. 11, 2012

(54) SYSTEMS AND METHODS FOR MEASURING A FLUID LEVEL WITHIN A WELL

(76) Inventors: Sam Gavin Gibbs, Midland, TX (US); Kenneth Bernard Nolen, Midland, TX (US)

( * ) Notice: Subject to any disclaimer, the term of this patent is extended or adjusted under 35 U.S.C. 154(b) by 0 days.

(21) Appl. No.: 13/354,782

(22) Filed: Jan. 20, 2012

Related U.S. Application Data

(62) Division of application No. 12/932,396, filed on Feb. 24, 2011, now Pat. No. 8,146,657.

(60) Provisional application No. 61/398,933, filed on Jul. 2, 2010.

(51) Int. Cl.
*E21B 21/08* (2006.01)

(52) U.S. Cl. ..... 166/250.03; 166/370; 73/152.55

(58) Field of Classification Search ..... 166/250.03, 166/313, 369, 370; 73/152.55, 152.53, 152.38; 367/908
See application file for complete search history.

(56) References Cited

U.S. PATENT DOCUMENTS

| | | | | |
|---|---|---|---|---|
| 2,324,340 | A | 7/1943 | Walker et al. | |
| 4,123,937 | A | 11/1978 | Alexander | |
| 4,391,135 | A | 7/1983 | Godbey et al. | |
| 4,934,186 | A | 6/1990 | McCoy | |
| 5,081,613 | A * | 1/1992 | Holzhausen et al. | 367/86 |
| 5,092,167 | A | 3/1992 | Finley et al. | |
| 5,375,465 | A | 12/1994 | Carlson | |
| 5,635,636 | A | 6/1997 | Alexander | |
| 5,715,890 | A * | 2/1998 | Nolen | 166/250.03 |
| 7,024,917 | B2 | 4/2006 | DiFoggio | |
| 7,212,923 | B2 | 5/2007 | Gibbs | |
| 7,347,089 | B1 | 3/2008 | Kelley et al. | |
| 7,784,538 | B2 * | 8/2010 | McCoy et al. | 166/250.03 |
| 8,036,829 | B2 | 10/2011 | Gibbs | |
| 2006/0131028 | A1 * | 6/2006 | Burris et al. | 166/370 |
| 2006/0133635 | A1 * | 6/2006 | Hill et al. | 381/369 |
| 2008/0135236 | A1 | 6/2008 | Schoell | |

* cited by examiner

*Primary Examiner* — Nicole Coy
(74) *Attorney, Agent, or Firm* — Thompson & Knight LLP; James J. Murphy

(57) ABSTRACT

A method of determining a fluid level in a well space without substantial venting of gas to the atmosphere or injecting a gas at high pressure. Gas being produced by the well is used to create a pressure differential between two spaces. A wave is induced in the well space by causing the two spaces to come into gaseous communication for a selected time internal. Pressure changes are measured as the induced wave travels through the gas in the well space from the measurement system to a fluid surface and back to the measurement system to determine a round trip travel time of the wave. The fluid level is calculated from the round-trip travel time and a speed of the wave as one-half of the product of the wave speed and the round-trip time.

13 Claims, 17 Drawing Sheets

SYSTEMS AND METHODS FOR MEASURING A FLUID LEVEL WITHIN A WELL

CROSS-REFERENCE TO RELATED APPLICATION

The present application is a divisional of U.S. patent application Ser. No. 12/932,396, filed Feb. 24, 2011, and claiming the benefit of U.S. Provisional Application Ser. No. 61/398,933, filed Jul. 2, 2010.

FIELD OF INVENTION

The present invention relates in general to oil and gas production techniques and in particular to systems and methods for inferring gas production in oil and gas wells.

BACKGROUND OF INVENTION

Natural gas produced from subterranean wells has long been an important source of energy and raw material. Natural gas is a clean burning fuel and is particularly applicable for household use and the generation of electricity. It can also be liquefied and used for powering land, seaborne and airborne vehicles. In its role as a raw material, it is commonly converted into fertilizer and a multiplicity of petrochemical products including plastics. At this writing it is abundant in the United States and figures prominently in the mix of energy resources to replace oil which is increasingly expensive and scarce.

Natural gas is usually produced in association with petroleum in so-called 'oil and gas' wells. Hydrocarbon wells usually produce water in addition to the oil and gas components. Without lifting liquid to the surface by external means, back pressure is exerted on the reservoir which impedes (or even stops) production into the well. Rod pumping is a frequently used method for lifting liquid to the surface. This system of equipment involves a surface reciprocating machine connected to a positive displacement subsurface pump with a string of sucker rods. Rod pumping has the ability to produce a low back pressure on the reservoir, which allows oil and gas to be produced to the surface at greater rates. While rod pumping is most commonly used, any artificial lift method that is vented is a candidate application for this invention.

FIG. 1A shows a typical oil and gas well being artificially lifted with rod pumping equipment 100. Generally, equipment 100 includes a pump 101 and rods 102, which are reciprocated with a surface pumping unit (not shown). Oil, gas and water comes into the wellbore and the liquids (oil and water and a small amount of gas) are pumped to the surface through tubing 103 and free gas travels to the surface through the annulus between tubing 103 and casing 104. Good production practice strives to vent as much as possible of the free gas upward through the casing-tubing annulus and check valve 105. A gas separator 106 discourages free gas from passing through pump 101 where it would otherwise severely diminish volumetric efficiency of the lift system.

FIG. 1B is a more detailed diagram of gas separator 106. Oil, water and gas enter the wellbore from the reservoir through casing perforations/open hole 107. In general, some of the gas is dissolved in the oil and some is free, i.e. in the gaseous state. Gas separator 106 is designed to separate and vent most of the free gas up the casing-tubing annulus. The free gas moving upward from the casing perforations generally will continue upward in the annulus past the tubing perforations 108.

The liquid (water and oil containing dissolved gas) is forced to move through tubing perforations 108 where it is sucked into pump 101 through suction tube 109. Hopefully, most or all of the free gas is removed by gas separator 106. Several different types of gas separators are available. All have the same purpose, i.e. to vent as much free gas as possible up the casing-tubing annulus. When it reaches the surface, the free gas is mixed with the oil, water and gas that passed through the pump and up the tubing 103 (FIG. 1A). Check valve 105 prevents produced fluids from falling back down the casing-tubing annulus.

Natural gas can also occur in wells in which little associated petroleum and water is produced. These are often termed simply as 'gas' wells. FIG. 1C shows a typical gas well. A packer 110 is typically used to seal-off the annulus and produce a better flow regime for gas and liquids to reach the surface.

When multiple gas-producing wells are producing into a single facility, for example a tank battery, allocating the amount of gas produced by the individual wells is important for calculating royalties, and so on. However, as discussed further below, allocating production between wells is a non-trivial process and is subject to a number of sources of errors.

SUMMARY OF INVENTION

According to one representative embodiment of the principles of the present invention, a method of inferring gas production is disclosed, which utilizes a conduit having an outlet controlled by a valve and in communication with a space within a well through which a gas volume is being produced. The method includes taking a selected number of measurements during a selected period of time. Each measurement includes closing the valve to allow gas pressure within the conduit to change, sampling the gas pressure within the conduit over a sampling time period, calculating a rate of pressure change from samples taken over the sampling time period, and calculating a rate of gas production in the conduit from the calculated rate of change of pressure, the gas volume, well characteristics and gas properties. The calculated rates of gas production are then summed for the selected number of measurements to determine an inferred rate of gas production through the conduit during the selected period of time.

According to another exemplary embodiment of the inventive principles, a method of determining a fluid level in a space in a well is disclosed, which utilizes a conduit in gaseous communication with the space in the well, a valve controlling gaseous communication through the conduit, and a tube in gaseous communication with the conduit through an aperture disposed at a point between the space and the valve. The method includes determining the ambient pressure in the conduit with the valve open and gas being produced in the space by the well and then closing the valve to cause gas pressure within the conduit to increase a selected amount above the ambient pressure. Next, the valve is opened for a selected time interval and then re-closed to create a rarefaction wave in the conduit and in the well and a plurality of conduit pressure measurements are taken for a selected time, the time selected to allow the rarefaction wave to travel at a previously determined speed to a fluid top within the space in the well and then return to the surface. The plurality of pressure measurements are evaluated to determine a round-trip time for the rarefaction wave to travel to the fluid top and return to the surface, the round-trip time being the time difference between initiation of the wave and its return to the surface. The fluid level is determined as half the product of wave speed and round-trip time.

A further embodiment of the principles of the present invention is disclosed in a method of determining fluid level in a space in a well and utilizes a conduit in gaseous communication with the space, a first valve controlling gaseous communication through the conduit, a storage chamber in selective gaseous communication with the conduit through a second valve, and a tube in gaseous communication with the conduit through an aperture disposed at a point between the space in the well and the valve. The method includes isolating the storage chamber from the conduit with the second valve closed, determining the ambient pressure in the conduit with the first valve open and gas being produced by the well, and opening the second valve to allow gaseous communication between the storage chamber and the conduit. The method also includes closing the first valve to cause gas pressure within the conduit to increase to a selected value above ambient pressure, closing the second valve to trap higher pressure gas in the storage chamber, opening the first valve to allow pressure in the conduit to return to the ambient value, closing the first valve, and then opening the second valve to create a compression wave in the conduit and the space in the well. A plurality of conduit pressure measurements are taken for a selected time, the time selected to allow the compression wave to travel at a previously determined speed to a fluid top within the space in the well and then return to the surface. The plurality of pressure measurements are evaluated to determine a round-trip time for the compression wave to travel to the fluid top and return to the surface, the round-trip time being the time difference between initiation of the wave and its return to the surface and the fluid level is determined as half the product of wave speed and round-trip time.

An additional embodiment is a method for calculating speed of a pressure wave in produced gas using a conduit in controlled communication through a valve with an annular space containing produced gas and a coiled resonating tube, the resonating tube having a first end coupled to the conduit through an aperture in the conduit upstream of the valve and a closed second end. The ambient pressure in the conduit is determined with the valve open and gas being produced in the annular space by the well. The valve is then closed to cause gas pressure within the conduit to increase a selected amount above the ambient pressure. Next, the valve is closed for a selected time interval and then reclosed to create a rarefaction pressure wave in the conduit and the annular space, which induces a wave in the resonating tube. Digitized pressure measurements are taken in the resonating tube for a time sufficient to determine a frequency of the induced wave using a Fast Fourier Transform (FFT). The frequency of the induced wave is determined from a FFT magnitude versus frequency spectrum and the speed of the induced wave in the annular space is computed as four times the product of the frequency of the induced wave in the resonating tube times the effective length of the resonating tube.

A method is also disclosed for calculating speed of a pressure wave in produced gas using a conduit in controlled communication through a valve with an annular space containing produced gas and a coiled resonating tube, the resonating tube having first and second ends respectively coupled to the conduit through first and second apertures in the conduit upstream of the valve. The method includes determining ambient pressure in the conduit with the valve open and gas being produced in the annular space by the well, closing the valve to cause gas pressure within the conduit to increase a selected amount above the ambient pressure, opening the valve for a selected time interval and then reclosing the valve to create a rarefaction pressure wave in the conduit and the annular space which induces a wave in the resonating tube. Digitized pressure measurements are taken in the resonating tube for a time sufficient to determine frequency of the induced wave using a Fast Fourier Transform (FFT) and the frequency of the induced wave determined from a FFT magnitude versus frequency spectrum. The speed of the pressure wave in the annular volume is computed as two times the product of the frequency of the induced wave in the resonating tube times the effective length of the resonating tube.

A further embodiment of the inventive principles is a method for calculating speed of a pressure wave in trapped gas using a conduit, in communication with an annular space containing produced gas and controlled by an outlet valve, and a coiled resonating tube, the resonating tube having a first end coupled through an isolation valve to the conduit through an aperture in the conduit upstream of the outlet valve and a closed second end. The method includes determining ambient pressure in the conduit with the outlet valve open and the conduit communicating with the annular space, closing the outlet valve with the isolation valve open to cause pressure in the annular space and the resonating tube to increase a selected amount above ambient pressure, closing the isolating valve and opening the outlet valve to allow conduit pressure to return to the ambient pressure, and opening the isolating valve for a selected time period and then reclosing the isolation valve while taking digitized pressure measurements in the resonating tube for a time sufficient to determine frequency of an induced wave within the resonating tube using a Fast Fourier Transform (FFT). The frequency of the induced wave is determined from the FFT magnitude versus frequency spectrum and the speed of the wave in the annular space is computed as two times the product of the frequency of the induced wave in the trapped gas tube times the length of the resonating tube.

Finally, a method is disclosed for allocating produced gas to a selected well among a plurality of wells at a central facility. The method includes, for each well in the facility, inferring gas production up the annulus of the well disposed between the outer wall of tubing of the well and the inner wall of the casing of the well. Inferring gas production includes taking a selected number of measurements during a selected period of time, each measurement including closing the annulus to allow gas pressure within the annulus to change, sampling the pressure within the annulus over a sampling time period, calculating the time rate of pressure change from samples taken over the sampling time period; and calculating the production rate of gas in the annulus. Inferring gas production also includes summing the calculated production rates for the selected number of measurements to determine an inferred rate of gas production through the annulus of the well during a selected period of time. For each well in the facility, and for a selected period of time, both the amount of gas produced through the tubing of the well and the amount of gas used for utilitarian purposes are determined. The total gas production value during the selected period of time is determined as the sum of the inferred production up the annulus and the determined amount of gas through the tubing less the determined amount of gas from the well used for utilitarian purposes. An allocation factor is calculated for the selected well as the ratio of the total gas production value for the selected well described above to the sum of the total gas production values for all of the plurality of wells in the facility. An allocation to the selected well is calculated as the product of the allocation factor and the total amount of gas sold from all of the plurality of wells in the facility during the selected period of time.

Embodiments of the present principles provide for systems and methods that allow for a more accurate allocation of gas between wells in multiple-well facilities. To this end, these embodiments allow for the gas production through the annulus of a well to be inferred with reasonable precision. Additionally, the principles of the present invention provide multiple methods of measuring the speed of sound, which can be particularly useful in measuring fluid levels within oil and gas wells. Advantageously, these methods of measuring fluid levels are "green", since they do not involve injection of foreign substances into the well or emitting gas from it into the atmosphere. The information obtained from the application of the principles of the invention is useful in continuous testing of individual wells, troubleshooting well problems and allocating gas from individual wells for reserve determination and division of cost and revenue.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1A:
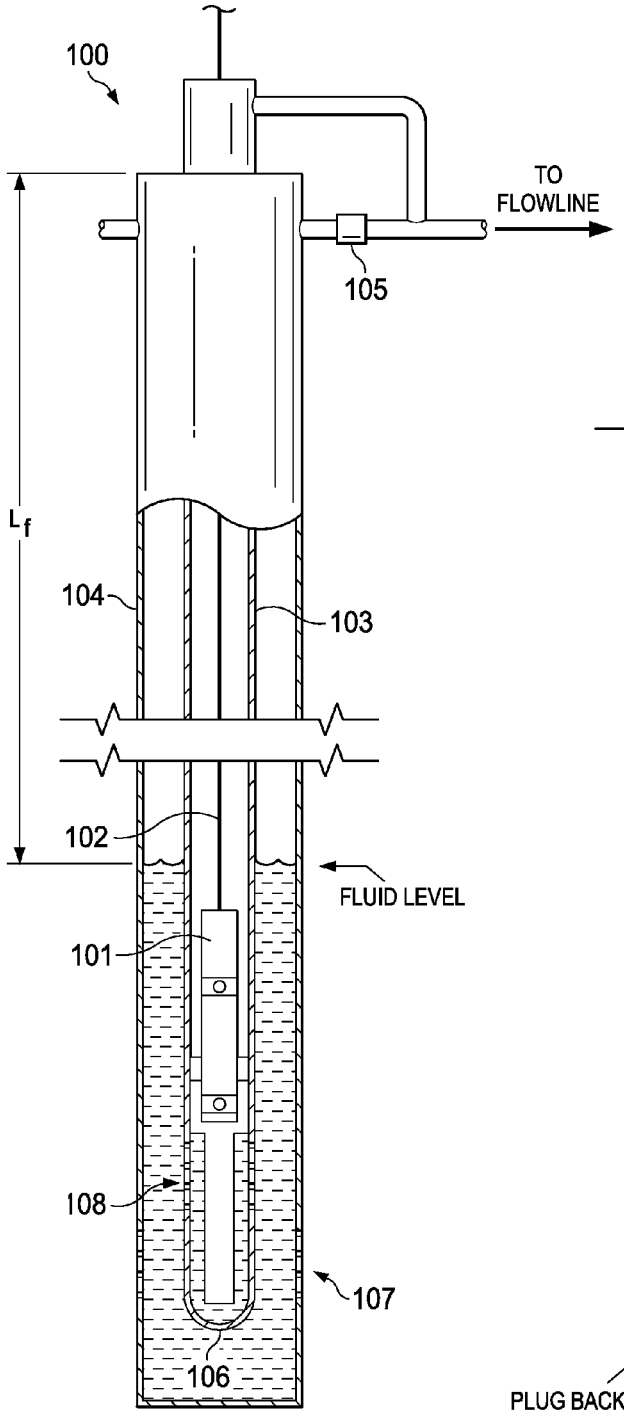
FIG. 1A (PRIOR ART)
FIG. 1A is a diagram of a portion of a typical vented pumping system for an oil and gas well.
Figure 1B:
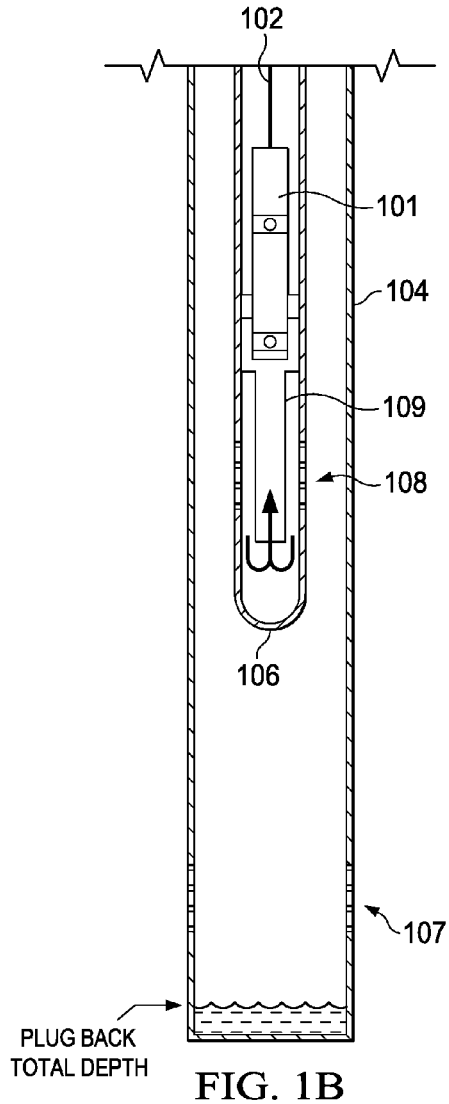
FIG. 1B (PRIOR ART)
FIG. 1B is a more detailed diagram of the typical gas separator shown in FIG. 1A.

The principles of the present invention and their advantages are best understood by referring to the illustrated embodiment depicted in FIGS. 1-19 of the drawings, in which like numbers designate like parts.

In oil and gas wells, the production stream is separated into volumes of oil, water and gas. The oil and gas components are measured and sold. The water is disposed-of unless it is suitable for agricultural or human use. Measurement of gas is most commonly done with orifice meters. In the United States, gas measurement is guided by the American Gas Association (AGA). A carefully machined orifice plate is placed in the gas stream in a meter run. The meter run is designed to minimize turbulence in the line to increase accuracy of the measurement. Gas pressure upstream of the orifice plate is measured along with differential pressure across the orifice plate. Temperature of the gas in the flow stream is also measured. Also, gas specific gravity (SG) determined from a gas sample analysis is required. Using equations specified by AGA, the rate of gas flowing through the meter run is computed in standard cubic feet (scf) at 14.65 psia pressure and 60 deg F. temperature. In the digital computer era, the calculations are accomplished using computers. Manual calculations using circular pressure charts are also possible. The volume of gas sold (scf) does not alone determine its value. The energy content of the gas (btu/scf) is also considered based on gas sample analysis.

The principles of the invention improve the allocation of gas to individual wells. When oil and gas on single-well leases are measured and sold, there is no allocation problem because only one well is involved. Allocation problems do exist on leases wherein a tank battery and measurement facilities serve many wells.

It is important to understand how liquid and gas are measured and allocated. Tankage for temporary storage of produced oil is provided collectively for all of the wells, but separation/treating/measurement facilities involve parallel paths. One branch is called the test branch. It measures oil, water and gas from a single well which is said to be 'on test'. A production test on an individual well is performed at least once during an accounting period, usually one month. The test may last for 24 hours or less if many wells are producing into the same central facility. Once a test is made, the well is assumed, of necessity, to produce at the tested rate throughout the remainder of the accounting period. The parallel branch handles production from the remainder of the wells on the lease. The phases (oil-water-gas) are separated and treated in the parallel (production) branch. The oil from the well on test is mixed with oil from the remainder of the wells and temporarily stored in tanks. Later the total stream of oil is accurately measured with a periodically calibrated meter or from gauging calibrated storage tanks and sold. Similarly, gas from the well on test is reunited with gas from the remainder of the wells. There is no practical way of storing gas in its gaseous state so the total gas stream is continuously measured and sold.

Figure 2:
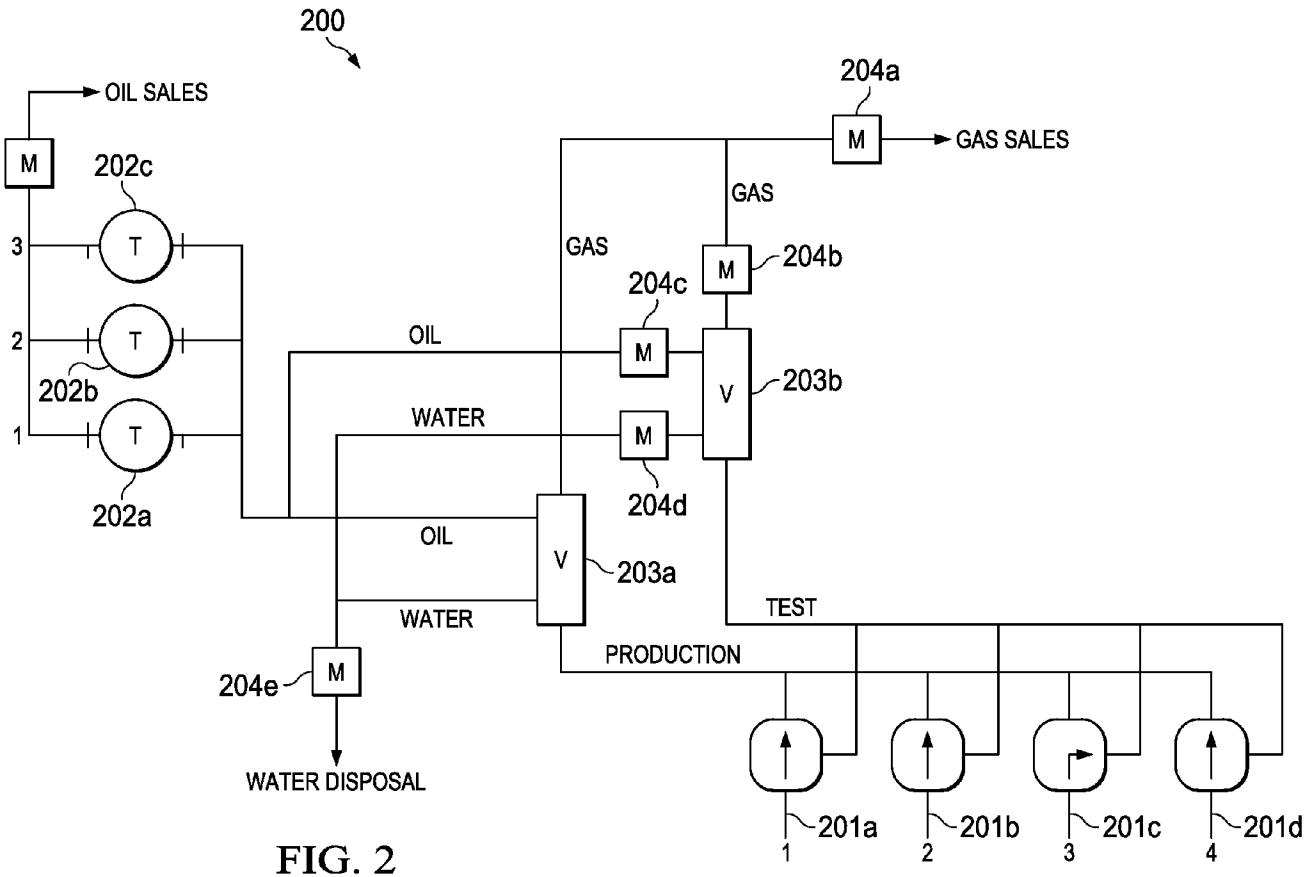
FIG. 2 (PRIOR ART)
FIG. 2 is a diagram of a representative oil and gas central facility.

FIG. 2 schematically shows a representative well equipped central facility 200 (often called a tank battery) serving four wells 201*a*-201*d*. (Various pumps and check-valves are omitted in FIG. 2 to improve clarity of the illustration.) In this example, facility 200 includes three tanks 202*a*-202*c*, a pair of vessels 203*a*-203*b*, and a number of meters 204*a*-204*e*. It should be noted that facility 200 is only exemplary, and the number of wells, tanks, vessels, meters, as well as their configuration, will vary in actual practice. In FIG. 2, Well 3 (201*c*) is on test while the first, second and fourth wells (201*a*, 201*b*, 201*d*) are producing into the parallel branch. The oil in Tank 3 (202*c*) is being measured and sold. Tank 2 (202*b*) is full and Tank 1 (202*a*) is being filled.

Opportunities abound for error in measuring and allocating the oil, water and gas streams from the wells on test. The meters may be out of calibration. Even if the meters are precise, the measurements may still be wrong. The well on test may not be producing during the entire test period. It may be inadvertently shut-down for chemical treatment, repair or other service. The amount of downtime is often estimated and the well's production typically takes several days to recover from the effects of downtime. Perhaps the greatest source of error in the testing procedure is the assumption that a well produces at the measured rate throughout the entire accounting period.

Usually the projected volume of oil produced by the tested wells does not agree with the total volume of oil known to be sold during the period. The same is true for gas production. A function called 'Production Accounting' has been created by oil and gas producers to allocate the discrepancy between actual sales and test production. Accurate production measurements are needed to assign income and cost to the individual wells, to assist in well surveillance and to supply reservoir engineers with data on which to base reserve estimates. Allocation of production to individual wells is not accurately accomplished with present single shot methods.

In a perfect world, the calculated sum of individual well tests in a period of time would equal the amount of gas sold during the same period. Since it rarely does, the production accounting section must reconcile the differences and assign the gas sold to individual wells in some equitable manner. It is important that gas be allocated properly because operating costs, royalty payments, payments to working interest owners and other financial matters are affected. Also the gas produced by an individual well is necessary in evaluating its economic worth and its contribution to hydrocarbon reserves of interest to stockholders. A common procedure is to compute the battery gas-oil ratio from actual gas and oil sold. Then produced gas allocated to a given well is taken to be the product of the battery gas-oil ratio multiplied by the oil produced by the individual well. An example will clarify the procedure.

A particular central facility (tank battery) serves 20 wells. Total oil sold from the battery in one month is 20460 b.oil. In the same period, 8.573 mmcf of gas is sold. Well No. 14 on the lease is credited with producing 465 b.oil in the month. How much gas production should be assigned to Well No. 14? Solution: The battery gas-oil ratio is computed to be 419 scf/b.oil [8,573,000/20460=419]. The gas assigned to Well No. 14 is 194.835 mcf [419(465)=194,835 scf].

The fallacy of the above procedure is that wells have different gas-oil ratios. Just like people, oil and gas wells are different. If it could be known, Well No. 14 is a 'good' gas producer and a 'poor' oil producer because of its stratigraphic position in the reservoir. If it could be known, Well No. 14 has an actual gas-oil ratio of 701 scf/b.oil. Thus in reality it should be credited with 325.965 mcf of gas [701(465)=325,965 scf] during the period. Even the oil production (465 b.oil) might be suspect because of down-time during the test or an oil metering error.

The various regulatory groups do not mandate a method for allocating gas production to a given well. They only mandate that gas from each individual well be reported. The producing company is responsible for devising the most accurate allocation method that they can. Different methods (from the average GOR method described above) exist. A particularly egregious method allocates gas to individual wells as if they produced equal amounts. In the example above, each well would have been allocated 428.650 mcf [8,573,000/20=428650 scf]. The regulatory agency probably would not have questioned the allocation. A royalty or working interest owner probably would have raised a question.

According to the principles of the present invention, inferred means the process of determining gas production by means other than direct measurement with a standard orifice meter. In particular, these principles provide a method for inferring the rate of casing gas flowing up the annulus in oil and gas wells. The process requires knowledge of fluid level in the casing and involves brief measurements of pressure buildup rates when the surface casing valve is closed. The casing/tubing annulus (i.e., the annulus between casing 104 and tubing 103 of FIG. 1A) forms a volume of gas from the fluid level upward to the surface. Gas is flowing into the volume at the liquid-fluid level interface. With the casing closed, pressure in the volume increases because the gas is trapped. Pressure buildup is measured at the surface. The present inventive principles use gas laws to calculate the rate of gas inflow into the (fixed) volume from the measured pressure buildup. Since the buildup measurement time is short (say 1 minute), the reservoir hardly knows that the surface casing valve has been closed. Thus the inflow rate during the pressure buildup measurement is virtually the same as the inflow rate during normal operation with the casing valve open.

Gilbert gave an empirical method for sensing gas rate flowing up a casing using a critical flow prover. This single-shot method is reviewed in Gipson, F. W. and Swaim, H. W. (1972): "Designed Beam Pumping," 19th Annual Meeting SW Petroleum Short Course, Lubbock, Tex., April, pp. 81-107. Podio et al. improved Gilbert's work using an empirical formula based on short term pressure build-up measurements. This too is a single-shot method (not continuous as in the subject invention). See, McCoy, J. N., Podio, A. L., Huddleston, K. L., and Drake, B. (1985): "Acoustic Static Bottomhole Pressures," SPE 13810, SPE Production Operations Symposium, Oklahoma City, Okla., March.

The relationship between pressure build-up rate and casing gas production rate is defined starting with the real gas law $$pV=znRT \quad \text{(Eq. 1)}$$

from which the time derivatives are formed:

$$V\frac{dp}{dt}=zRT\frac{dn}{dt}. \quad \text{(Eq. 2)}$$

V is the volume of gas which is constant and therefore not part of the differentiation process. Similarly the gas compressibility factor z, the universal gas constant R and the gas temperature T are treated as constants and are not differentiated. n is the number of pound mols of gas and p is its pressure. Symbols and units are defined in the Nomenclature listing set forth below. Ultimately V will be expressed in mol volumes. In anticipation of this, we offer two definitions:

Definition 1: A pound mol is defined as the pounds of gas equal to the number that expresses the molecular weight of the gas. For example the molecular weight of air is 28.96. Thus 28.96 pounds of air equals one pound mol. Definition 2: Mol volume is defined as the volume occupied by one pound mol of gas at a particular pressure and temperature.

The unknown in Equation 2 is the rate of mass inflow into the volume, i.e.:

$$\frac{dn}{dt}=\frac{V}{zRT}\frac{dp}{dt}. \quad \text{(Eq. 3)}$$

When we establish the number of pound mols flowing into the volume per day (dn/dt), we establish the number of standard cubic feet per day flowing up the casing (mcf/d). We use temperature at bottom of the gas column $T_b$ in Equation 3.

Let us now establish the relationship between pound mols and standard cubic feet of gas. The American Gas Association defines standard pressure and temperature for gas as 14.65 psia and 60 deg F., respectively. The specific gravity of the gas G is referred to air. Thus the molecular weight M of a hydrocarbon gas is given by:

$$M=28.96G \quad \text{(Eq. 4)}$$

and one pound mol of the gas becomes by definition:

$$\text{One pound mol}=28.96G\text{ pounds.} \quad \text{(Eq.5)}$$

The universal gas constant R is found from a relation discovered long ago by the developers of thermodynamics:

$$R=\frac{1544}{M} \quad \text{(Eq. 6)}$$

This simple relationship is accurate enough for practical purposes for most gas mixtures of interest. Now we can establish the relationship between pound mols and standard cubic feet of gas. We start with Equation 3 rearranged:

$$V=\frac{znRT}{p} \quad \text{(Eq. 3 rearranged)}$$

and evaluate the volume of one pound mol at standard conditions:

$$V=\frac{(1)(28.96G)(1544)T}{p(144)(28.96G)}=\frac{1544T}{144p}=\frac{1544(460+60)}{144(14.65)}=380.584scf.$$

In the relationship above, engineering units are used i.e. pressure in psf and temperature in deg R. In the future we will consider that one pound mol of gas occupies 381 scf at standard conditions; thus:

$$Mcf/d=0.381(\text{pound mol/d}) \quad \text{(Eq.7)}$$

will be our relationship between pound mols and Mcf. This completes the preliminary work.

Equation 3 is the key expression in the method. We shall incorporate proper dimensional factors, i.e. changing the units of pressure buildup from psi/min to psf/d. Further we will express V in mol volumes, i.e. V/M. Equation 3 becomes:

$$\frac{dn}{dt}=\frac{144(1440)V}{zMRT_b}\frac{dp}{dt} \quad \text{(Eq. 8a)}$$

We combine Equations 7 and 8a to obtain the simple form:

$$mcf/d=\frac{0.381(144)(1440)V}{zMRT_b}\frac{dp}{dt} \quad \text{(Eq. 8b)}$$

$$mcf/d=\frac{79004V}{zMRT_b}\frac{dp}{dt} \quad \text{(Eq. 8c)}$$

When Equation 8c is tested against state of the art orifice meters, it is found that it does not produce accurate answers. The answers are too low. We then do the unobvious by replacing the volume V with k V. This declares the gas volume to be an adiabatic volume. k is the ratio of gas specific heat at constant pressure to the specific heat at constant volume. Equation 8c becomes:

$$mcf/d=\frac{79004kV}{zMRT_b}\frac{dp}{dt} \quad \text{(Eq. 8d)}$$

When this is done, the answers from Equation III.8d agree closely with actual measurements. The thought of declaring the volume as adiabatic came from an historical incident. In Proposition 49 of Book 2 of his *Principia*, Isaac Newton (1642-1727) calculated the speed of sound in air. Newton's value was too low. Later the mathematician Pierre-Simon de Laplace (1749-1827) revisited Newton's solution and reasoned that the process of sound moving through air was adiabatic rather than isothermal as Newton had assumed. Using Newton's original method and considering that the pressure waves were governed by an adiabatic process, Laplace computed a speed in close agreement with measurements. Note in Table 1 in the Appendix that Equation 8d computes gas rates in close agreement with orifice meter measurements during a 3 hour test period. The experiment was made manually with pressure buildup measurements taken on 5 minute intervals. This was done after declaring the volume V to be adiabatic.

In the development of Equation 8c, no assumption about the shape of the volume V is made. It has no top or bottom. How did gas fill the annular volume? It moved into the space from bottom to top with a process similar to the propagation of sound. Thus it is reasonable to declare it adiabatic simply by replacing V with kV as is done when determining bulk modulus of ideal gases. We also list some other helpful formulas:

$$T_b = 460 + 0.01\nabla_t L_f \quad \text{(Eq. 9)}$$

$$V = \frac{\pi(d_{cid}^2 - d_{tod}^2)L_f}{4(144)} \quad \text{(Eq. 10)}$$

An example will help clarify the procedure. Determine:

Compute the Casing Gas Rate for the Following Well:

Fluid level, $L_f$: 6895 ft from surface (measured)

Casing internal diameter, $d_{cid}$: 4 in.

Tubing outer diameter, $d_{tod}$: 2.375 in.

k: 1.178 (computed from gas analysis)

Pressure buildup rate, dp/dt: 0.47 psi/min (measured with pressure transducer)

Geothermal temperature gradient, $\nabla_t$: 0.8 deg F./100 ft

Specific gravity of gas, G: 0.944 (computed from gas analysis)

z=0.99

Solution:

$$T_b = 460 + 0.01(0.8)(6895) = 515 \text{ deg R} \quad \text{(Equation 9)}$$

$$V = \frac{\pi(4^2 - 2.375^2)6895}{4(144)} = 390 \text{ ft}^3 \quad \text{(Eq. 10)}$$

$$M = 0.944(28.96) = 27.34 \quad \text{(Eq. 4)}$$

$$R = \frac{1544}{27.34} = 56.47 \quad \text{(Eq. 6)}$$

From Equation 8d, the required solution is:

$$mcf/d = \frac{79004kV}{zMRT_b}\frac{dp}{dt} = \frac{79004(1.178)(390)}{0.99(27.34)(56.47)(515)}(0.47) = 21.672 mcf/d$$

Since the gas is being sold, both the seller and purchaser will have current gas analyses. The preferred way of computing required gas properties is by use of the gas analysis. Table 2 in the Appendix shows a typical analysis showing percent by weight, molecular weight of each component, and $MC_p$ values for calculating k. We first compute the specific gravity G from the data of Table 2 as $$G = \frac{0.01\sum_{i=1}^{i=12}(\text{Mol }\%)_i(\text{MolWt})_i}{28.96} \quad \text{(Eq. 11)}$$

Computed specific gravity based on air is 0.944 based on Equation 11 and the molecular weights compiled by Natural Gas Suppliers Association (1966): *Engineering Data Book*, Published by Natural Gasoline and Natural Gas Processing Industries; Tulsa, Okla., p. 47 (Eighth Edition).

We also need to derive the k value from the gas analysis. First we calculate $MC_p$ for the mixture from:

$$(MC_p)_{mixture} = 0.01\sum_{i=1}^{i=12}(\text{Mol }\%)_i(MC_p)_i \quad \text{(Eq. 12)}$$

and then find k from:

$$k = \frac{(MC_p)_{mixture}}{(MC_p)_{mixture} - 1.99} \quad \text{(Eq. 13)}$$

The value for k calculated from Table 2 and Equations 12 and 13 is 1.178. The values for MCp in Table 2 are for 150 deg F. Values for other temperatures are compiled by Natural Gasoline Association of America (1957): *Engineering Data Book*, Published by Natural Gasoline and Natural Gas Processing Industries; Tulsa, Okla., p. 26 (Seventh Edition). The value for compressibility factor z is 0.99 and is found in this reference on pages 19-20.

The speed of sound (also known as wave speed) in gas v is also needed to compute the fluid level $L_f$. This is used in computing gas volume V in Equation III.8d. The formula for v is found in Nolen, K. B, Gibbs, S. G. (1996): *Measurement and Interpretation of Fluid Levels Obtained by Venting Gas*, SPE 38791 presented at SPE Annual Technical Conference and Exhibition; San Antonio, Tex., p. 2 and is:

$$v = \sqrt{\frac{(1716.1)kzT_b}{G}} \quad \text{(Eq. 14)}$$

The temperature $T_b$ is expressed in deg Rankine. For the gas analysis of Table III-1 and for $T_b$ of 515 deg R, we calculate:

$$v = \sqrt{\frac{(1716.1)(0.99)(1.178)(515)}{0.944}} = 1045 \text{ ft/sec.}$$

This value is within 12 ft/sec of the measured value (1.1 percent error).

A least squares method is used compute the rate of increase of casing pressure dp/dt while the electric valve is closed. This buildup rate is used in Equation 8d to compute the instantaneous daily rate mcf/d. If the sampling errors are Gaussian, least squares produces the most probable buildup rate. Each sample is taken at time $t_i$ (sec). The various least squares quantities are:

$$A = -\sum_{i=1}^{i=n} p_i \quad \text{Eq. 15}$$

$$\beta = \sum_{i=1}^{i=n} t_i \quad \text{Eq. 16}$$

$$C = -\sum_{i=1}^{i=n} p_i t_i \quad \text{Eq. 17}$$

$$D = \sum_{i=1}^{i=n} t_i^2 \quad \text{Eq. 18}$$

The pressure buildup rate is found from:

$$dp/dt = \frac{nC - A\beta}{\beta^2 - nD} psi/\min \quad \text{Eq. 19}$$

See, for example, Sokolnikoff, I. S, and E. S. (1941): *Higher Mathematics for Engineers and Physicists*, Mc-Graw Hill Book Company, Inc., New York and London, pp. 536-544.

Figure 3:
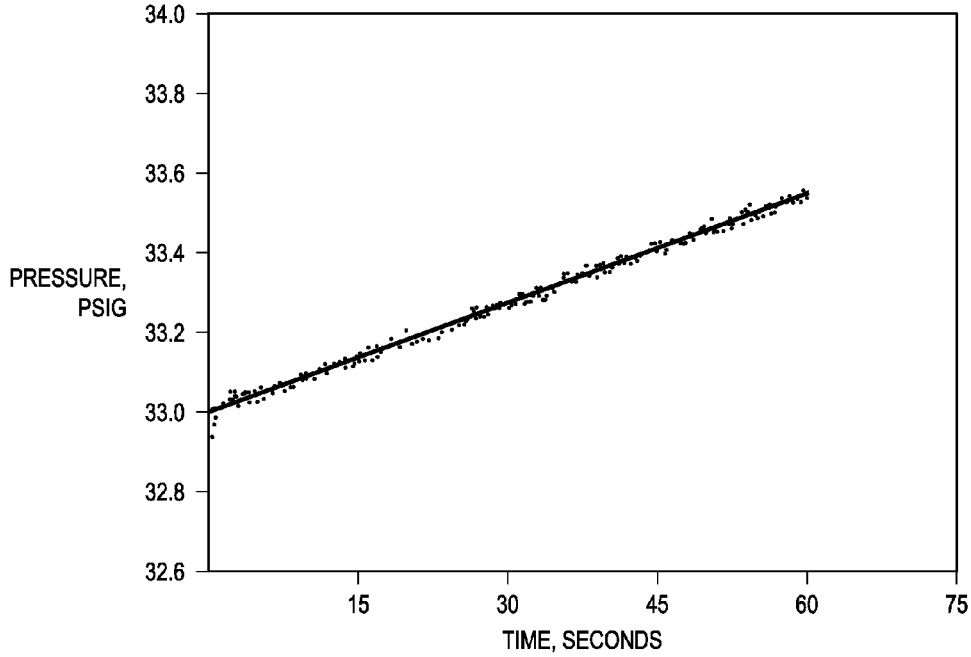
FIG. 3 (PRIOR ART)
FIG. 3 is a diagram of a representative pressure build-up graph.

FIG. 3 shows typical pressure buildup data with the linear least squares representation shown as the solid line. In particular, FIG. 3 shows the most probable buildup rate of 0.551 psi/min derived with Equation 19 from data subject to measurement error.

Equation 8d expresses gas rate in mcf/d. This rate does not persist all of the day. Instead it is only an instantaneous rate which is extrapolated to a daily rate. In many wells the instantaneous rate varies widely during the day. We need to take enough buildup measurements during the day to represent, at least approximately, the variations during the day. Table 1 summarizes measurements taken every 5 minutes (M) on a stable well with relatively small variations in production during the day. We choose the trapezoidal rule to sum the instantaneous rates to a close approximation to the exact daily rate. The trapezoidal rule is:

$$mcf/d = \frac{1}{N}\left(\frac{(mcf/d)_0 + (mcf/d)_N}{2} + \sum_{i=1}^{i=N-1} (mcf/d)_i\right) \quad \text{(Eq. 20)}$$

The rates enclosed in parentheses are the various rates calculated from Equation 8d based on pressure buildup rates taken at equal time increments, M minutes apart. $(mcf/d)_0$ represents the instantaneous rate at the beginning (midnight) of the preceding day. $(mcf/d)_N$ represents the instantaneous rate at the ending of the day (midnight). N is the number of pressure buildup measurements taken per day at equal time increments, M minutes apart. Thus in Equation 20:

$$N = \frac{1440}{M} \quad \text{(Eq. 21)}$$

If the measurements are taken every 5 minutes, N=288.

Integral calculus tells us that precision can be increased by taking more measurements per day. There is, however, a limit to how often the well can be shut-in for measuring pressure buildup. The well's behavior might be affected (production might be lost) if the well is shut-in too often. Intervals of 5 minutes seem to be a good compromise.

Because of the need to make occasional fluid level measurements, it might not be possible to make the pressure buildup measurements exactly M minutes apart. This is especially true in low volume wells which take a considerable period of time to store-up enough pressure energy to obtain a recognizable fluid level echo. In this case we need an alternate to Equation 20 above. Assume that we take Q+1 measurements at times $t_i$ (minutes after midnight) which most computer programming systems can track. Our formula becomes:

$$mcf/d = \frac{1}{2880}\sum_{i=0}^{i=Q-1} (t_{i+1} - t_i)((mcf/d)_{i+1} - (mcf/d)_i) \quad \text{(Eq. 22)}$$

As before $(mcf/d)_0$ is the instantaneous rate at beginning of the day (midnight) and $(mcf/d)_Q$ is instantaneous rate at end of the day (next midnight). Obviously $t_0$=0 and $t_Q$=1440 such that:

$$\sum_{i=0}^{i=Q-1} (t_{i+1} - t_i) = 1440 \text{ minutes (one day).}$$

We include the gas produced during the period of storing energy for a fluid level shot as follows. Let j be a particular i in Equation 22. $t_j$ is the time (min after midnight) when the valve is closed and energy begins to be stored. $t_{j+1}$ is the time when the storage process is complete. The pressure buildup rate in psi/min is taken to be:

$$dp/dt = \frac{p_{j+1} - p_j}{t_{j+1} - t_j} \quad \text{(Eq. 23)}$$

Equation 8d is then used to compute $(mcf/d)_{j+1}$ in the sum of Equation 22.

The principles of invention use the summation formulas above to produce production reports such as Table 3 of the Appendix.

Proper allocation of produced gas in a central facility to individual wells is one of the principal goals of this invention. The following terms are important in the allocation process. All of the terms pertain to an accounting period, say one calendar month. The central facility serves n wells.

S, mcf: Unlike oil which can be stored temporarily in tanks, gas must be metered and sold as it is processed at the central facility. S is the total gas produced up the casing and through the tubing by all of the wells in the central facility minus the total gas used for utilitarian purposes. This is an actual amount of gas which is measured with a calibrated sales meter.

U, mcf: The gas used for utilitarian purposes is that used at the central facility plus the gas used at individual well sites in powering pumping unit engines. U is the total amount used during the accounting period. In large central facilities, it is feasible to measure utilitarian gas. The quantities used at well sites would usually be estimated. The utilitarian gas used at the central facility is primarily used for heater-treaters and control valves. An unknown amount of gas is lost to leaks.

$U_i$, mcf: This is the gas used for utilitarian purposes by well i. This quantity is greater when produced fluid volume is large and when a gas engine is used to power its pumping unit.

$IC_i$, mcf: This is the casing gas inferred to be produced using the invention from well i.

$T_i$, mcf: This is the tubing gas estimated or inferred (See U.S. Pat. No. 7,212,923) to be produced by well i.

$f_i$ Allocation factor for well i. See Equation 24.

$AG_i$, mcf: Gas allocated to well i during the accounting period as given by Equation 25. This could serve as a royalty payment, if appropriate.

$TG_i$, mcf: This is the total gas (up casing and through tubing) produced by well i in the accounting period. This amount of gas would be reported to reservoir engineers who prepare reserve estimates for company management and stockholders. This amount could also be reported to production accountants for their use in allocating production cost. See Equation 26.

$$f_i = \frac{(IC_i + T_i) - U_i}{\sum_{i=1}^{n} (IC_i + T_i) - U} \quad \text{(Eq. 24)}$$

$$AG_i = f_i S \quad \text{(Eq. 25)}$$

Note: Inasmuch as $$\sum_{i=1}^{n} f_i = 1,$$

Equation 25 will allocate exactly S mcf of measured gas. Also note that allocation formula 24 penalizes a well with high utilitarian gas cost.

$$TG_i = AG_i + U_i \quad \text{(Eq. 26)}$$

An example will explain the process of allocating gas to an individual well. A large central facility serves 25 wells, all equipped with the invention. The casing gas for all of the wells in a one month accounting period is inferred to be 31,232 mcf with the invention. An additional 2231 mcf is inferred to be produced through the tubing with devices based on U.S. Pat. No. 7,212,923. This additional quantity can also be estimated with other methods. Utilitarian gas used is 2495 mcf (burned to separate oil and water). All of the wells are powered by electric motors so no gas is required for engines. 29405 mcf of gas was sold from the central facility during the month. The invention indicates that Well 14 produces 1251 mcf of casing gas. Additionally, 190 mcf of tubing gas is inferred to be produced by Well 14. It is estimated that Well 14's share of utilitarian gas is 99 mcf. (1) Of total gas sold during the accounting period, how much gas should be allocated to Well 14? (2) Determine total gas production from Well 14 during the accounting period.

Solution: To answer part (1), use Equation 24 to compute an allocation factor of:

$$f_{14} = \frac{(IC_{14} + T_{14}) - U_{14}}{\sum_{i=1}^{n} (IC_i + T_i) - U} = \frac{(1251 + 190) - 99}{31{,}232 + 2231 - 2495} = 0.0433.$$

Equation 25 indicates the amount of gas that should be allocated to Well 14:

$$AG_{14} = f_{14} S = 0.0433(29405) = 1273 \text{ mcf.}$$

This value should be reported to production accountants. It could serve as a royalty payment, if appropriate. Note that it considers the well's share of utilitarian gas.

To answer part (2), use Equation 26:

$$TG_{14} = AG_{14} + U_{14} = 1273 + 99 = 1372 \text{ mcf.}$$

This amount should be reported to reservoir engineers and production accountants for their purposes. Note the definition of S which admits that the amount of gas sold is the total amount of gas produced minus utilitarian gas used. This is why Equation 26 adds the well's share of utilitarian gas to its allocated share of gas sold. The accountant might use this amount to allocate production cost.

Figure 4A:
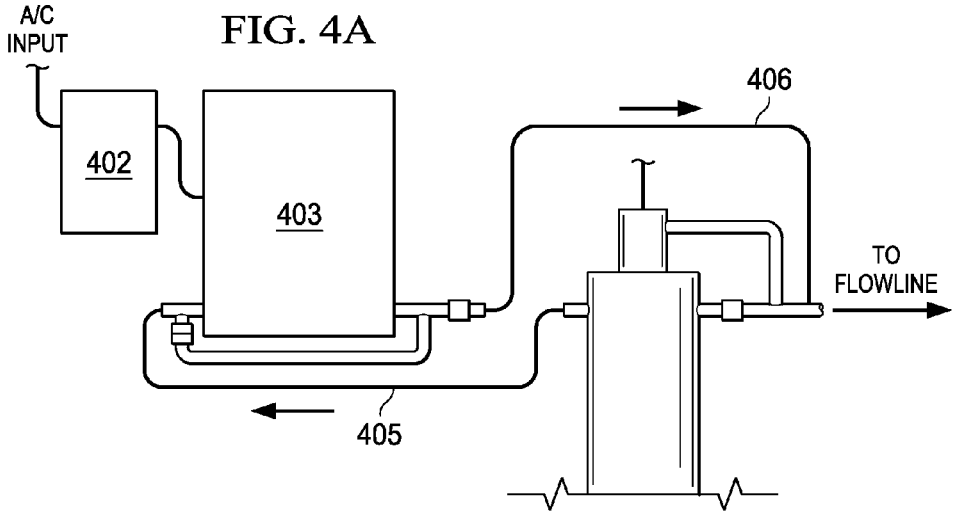
FIG. 4A is a high level conceptual diagram showing the connections between a typical wellhead and gas production inference equipment according to one embodiment of the principles of the present invention.

Some users of the principles of the present invention might prefer to leave their wellheads unmodified. For example, they might prefer to locate the additional components required by the invention in a parallel branch as shown in FIG. 4A. In this case, the original flow path is closed which forces the gas to pass through the parallel branch provided by a high pressure flexible hose 401. Units 402 and 403 include the measuring and processing hardware for implementing the principles of the present invention and will be discussed in detail below.

Figure 4B:
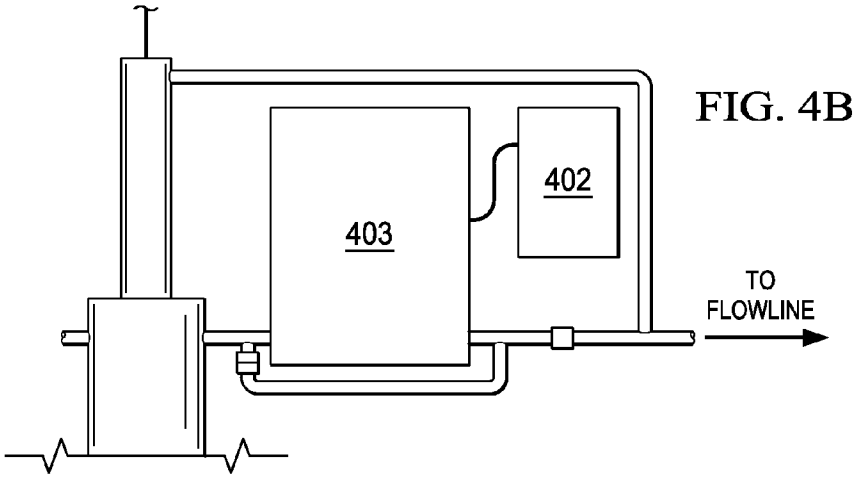
FIG. 4B is a high level conceptual diagram showing the connections between a typical wellhead and gas production inference equipment according to another embodiment of the principles of the present invention.
Figure 4C:
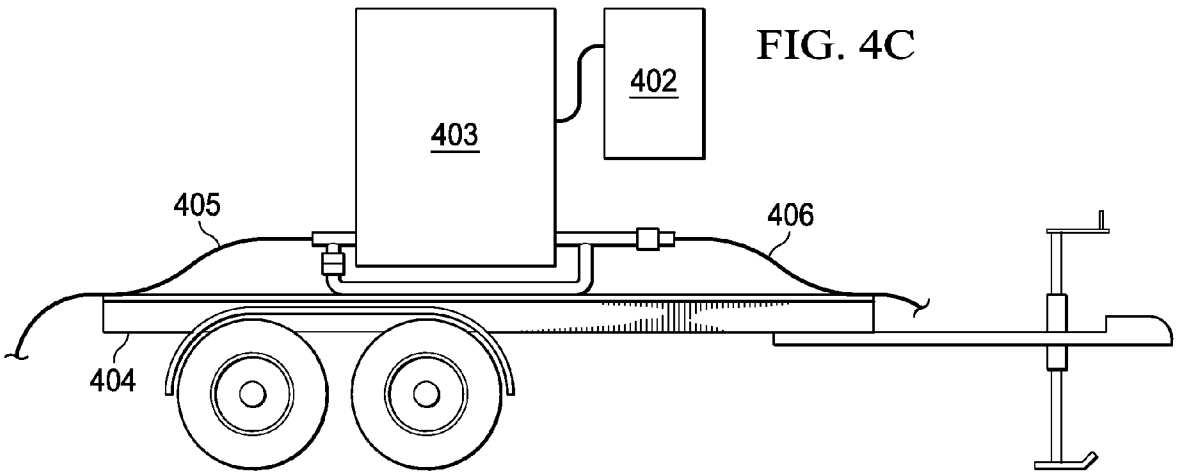
FIG. 4C is a high level conceptual diagram showing trailer-mounted embodiment of gas production inference equipment according to the principles of the present invention.

Other users might prefer to build systems according to the invention into the wellhead as shown in FIG. 4B. The invention enclosures 402 and 403 can be moved away from the wellhead should OSHA require it. A third arrangement is shown by FIG. 4C, which depicts the units 402 and 403 mounted on a trailer 404 for portability. This version includes flexible inlet and outlet hoses 405 and 406 for connection into the casing and flowline.

Figure 5:
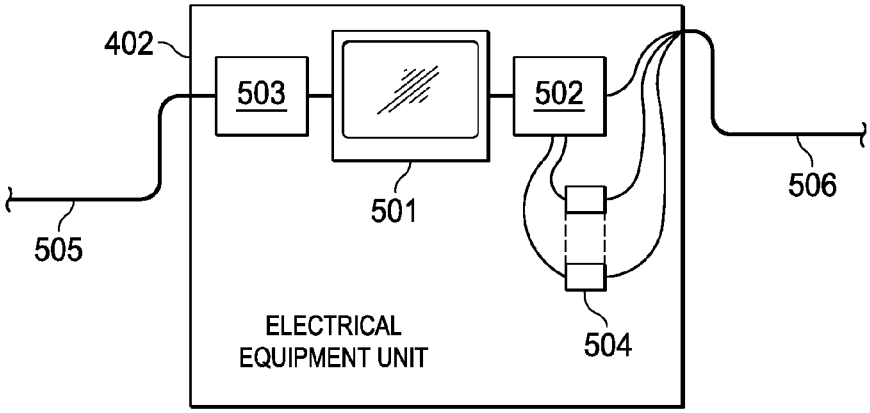
FIG. 5 is a high level functional block diagram of the internal equipment within electrical equipment unit shown in FIGS. 4A-4C.

Electrical equipment unit 402 is shown in further detail in FIG. 5 and includes computer/monitor units 501, data acquisition module (DAM) 502, D-C power supply 503, and a set of relays 504 for opening/closing the electrical valves in mechanical equipment unit 403. DAM 502 performs the dual function of analog to digital conversion (A-D) and signaling the relays to open and close the electric valves. Electrical equipment unit is supplied with 115 v A-C power through A-C line 505.

Electrical equipment unit 402 is connected to mechanical equipment unit 403 with a multi-conductor shielded cable 506. Electrical equipment unit 402 is preferably configured the same (number of relays excepted) way regardless of the features of the invention being implemented in various forms of mechanical equipment unit 403. Electrical equipment unit 402 is preferably located near the pumping unit motor control box (not shown) and connected to mechanical equipment unit 403 with a buried electrical cable 506 in conduit.

Figure 6A:
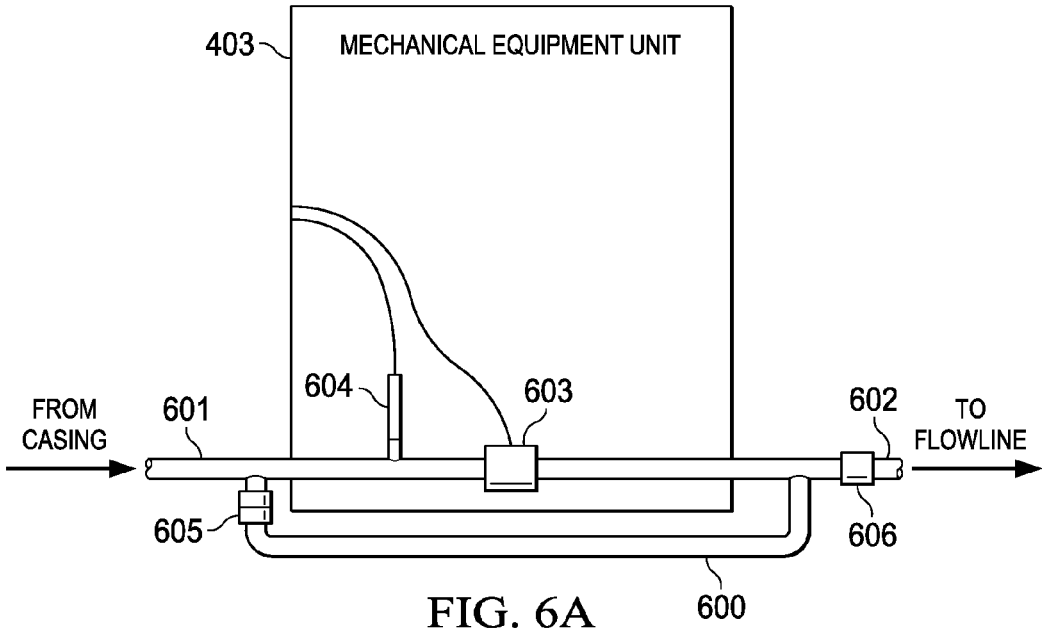
FIG. 6A is a high level functional block diagram of the internal equipment within the mechanical equipment unit shown in FIGS. 4A-4C for an embodiment of the principles of the present invention in which the annular gas volume is inferred without fluid level measurement capability.

As shown in FIG. 6A, which is an embodiment of the present principles that does not have fluid level capability, mechanical equipment unit 403 is connected to the annulus with high pressure flexible hose (inlet 601), which brings in gas from the annulus (FIG. 1A). The outlet 602 of mechanical equipment unit 403 connects to the flowline downstream of the point where annular gas is recombined with tubing fluids in the standard wellhead. In-line with inlet 601 and outlet 602 is an electric valve 603. A pressure transducer 604 measures the line pressure.

Associated with mechanical equipment unit 403 is a relief valve 605 and a check valve 606 that sends gas through bypass line 600 should the electrically operated valve 603 fail closed.

Inferring gas production through the casing-tubing annulus in oil and gas wells normally requires measurement of fluid level. This is necessary to establish the volume of gas in the annular area (see Equation 10). The nature of the well determines the frequency of fluid level measurements. Many wells only require a fluid level at setup time with infrequent checks thereafter. Good production practice strives to keep the fluid level near the pump at all times. This creates low back pressure on the reservoir and promotes the largest possible rate of inflow into the wellbore. The artificial lift equipment, properly designed, maintains the fluid level near the pump. It is probable that a fluid level is not needed at all in this type of well, since it is reasonable to manually input a fluid level at or near the pump. Slight variations in fluid level during on-off operations will cause slight errors in inferred gas production. These errors might be deemed tolerable inasmuch as the inferred rate is being used for allocation purposes and surveillance and not for product sales.

The embodiment of mechanical equipment unit 403 shown in FIG. 6A is capable of inferring gas production in a well where the fluid level capability is not required. The digital computer/monitor system 501 of electrical equipment unit 402 (FIG. 5) is the heart of the process. Digital computer/monitor system 501 keeps track of time and performs the calculations. At the appropriate time digital computer/monitor system 501 signals electrically controlled valve 603 (normally open) to close. Immediately thereafter it signals the A-D converter within DAM 502 to digitize pressure data supplied by the pressure transducer 604 (FIG. 6) for a specified period of time. The computer/A-D converter systems stores the measured casing pressures as pressure increases. After a pre-determined buildup time, digital computer/monitor system 501 signals electric valve 603 to open.

Digital computer/monitor system 501 then computes the pressure buildup rate dp/dt and solves for instantaneous mcf/d using Equation 8d. It stores all of the computed rates during the day. Upon command during the day, or at the end of the day, it produces a report similar to that shown in Table 3.

The process of inferring gas production using the embodiment of mechanical equipment unit 403 shown in FIG. 6A (without fluid level monitoring) is as follows. Digital computer/monitor system 501 determines the time of pressure buildup measurements subject to the operator selected frequency of buildups. When the time comes to perform a buildup measurement, digital computer/monitor system 501 closes electric valve 603 and activates the A-D converter within DAM 502 (FIG. 5) to sample pressure for a predetermined time. After the digitizing time elapses, digital computer/monitor system 501 opens electric valve 603 and begins to wait for the next buildup at which time the process is repeated. Digital computer/monitor system 501 processes the pressure buildup data using Equation 19 to determine dp/dt. Equation 8d is then used by digital computer/monitor system 501 to calculate the extrapolated daily rate mcf/d. The cumulative production (from Equation 20 or 22) is then available for display on demand. At the end of the day, the report of total mcf produced during the day is prepared.

In most cases, the embodiments of the present invention measure fluid level from the surface (ground level) automatically or on demand. This is needed to determine volume of annular gas. When multiple producing zones are involved or when wells are strong, the fluid level can change markedly during the day. To obtain fluid level two items are needed: (1) a record of digitized annulus pressures at the surface which contains a pressure wave reflection off the subsurface fluid level; and (2) knowledge of the speed of sound in the gas v. The preferred method for obtaining v uses the gas analysis method as described above. Alternate methods based on pipe organ theory and trapped gas are also available. The record of digitized pressures is also obtained with a preferred method about to be described. The fluid level is found by creating an annular pressure wave at the surface which travels downward, reflects off the fluid level, and returns to the surface. The round-trip time $T_{rt}$ (sec) of the wave is measured by the computer. The fluid level $L_f$ from surface is computed from:

$$L_f = \frac{vT_{rt}}{2} \quad \text{(Eq. 27)}$$

The principles of the present invention provide two preferred methods for creating a pressure wave at the surface. One method sends a rarefaction wave down the annulus in search of the fluid level. The other method sends a compressive wave down the annulus to locate the fluid level. Both of the methods are 'green' i.e. no gas is vented to the atmosphere and no foreign substance is injected into the well.

Figure 6B:
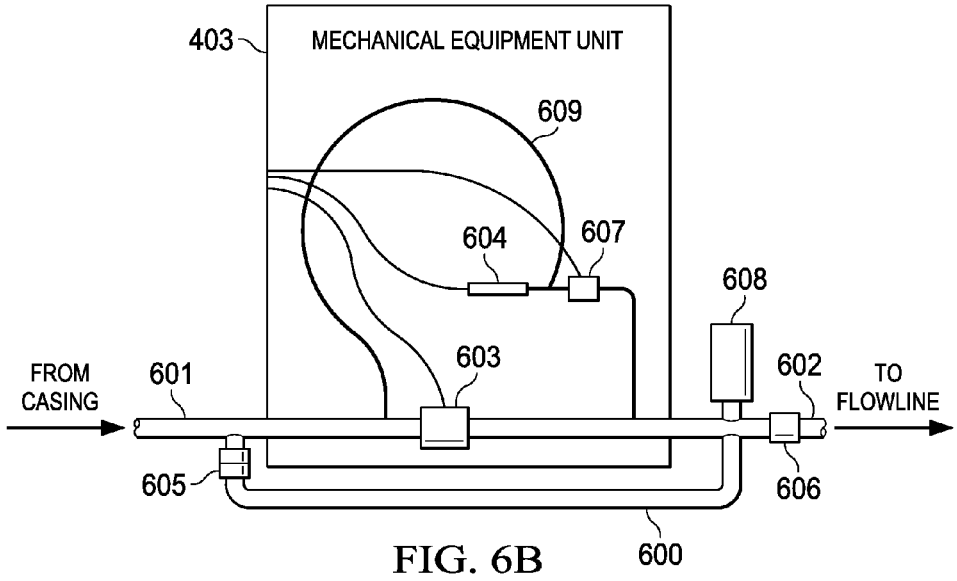
FIG. 6B is a high level functional block diagram of the internal equipment within the mechanical equipment unit shown in FIGS. 4A-4C for an embodiment of the principles of the present invention in which the annular gas volume is inferred, the liquid fluid level is determined with a rarefaction wave, and the speed of sound is measured with pipe organ theory.

FIG. 6B illustrates a second embodiment of mechanical equipment unit 403 suitable for creating a green rarefaction wave in locating the fluid level. The embodiment of FIG. 6B includes a second electric valve 607 near pressure transducer 604 and at a point downstream of valve 603. A surge chamber 608 is also provided. A flexible (coiled) tube 609 connects a point upstream of valve 603 to a point upstream of valve 607.

Valve 607 is normally closed and valve 603 is normally open. To infer gas rate, the same procedure is used as described above. Valve 603 is closed to cause pressure to change. The A-D converter is started and pressure is measured for a specific amount of time. Then, dp/dt is computed and mcf/d is computed using Equation 8d and stored. Valve 603 is opened again and the process continues. Various reports are prepared using the stored mcf/d as previously described.

To create a green rarefaction wave to seek the fluid level with the embodiment of mechanical equipment unit 403 shown in FIG. 6B, the following procedure is preferably employed, in which valves 603 and a 607 begin in their normal states (open and closed, respectively).

First, the ambient casing pressure is measured with pressure transducer 604 by sampling pressure at 5 hz for one minute. Ambient casing pressure is taken to be the average of these 300 samples.

Next, energy for creating the rarefaction wave is stored in the casing annulus. Specifically, to store energy, computer/monitor system 501 signals DAM 502 to close valve 603 and to operate the A-D converter at 1 hz to monitor increase in annulus pressure. When the pressure increases a pre-selected amount above ambient pressure, the A-D process is stopped. If the well is shallow, an overpressure of 2 psi might be sufficient to receive an echo from the fluid top in the annulus. If the well is deep or if the annulus is small, a larger overpressure (say 10 psi or more) might be required. Experimentation on a given well will decide the issue of required overpressure.

When the desired overpressure (above ambient) is reached the A-D converter is stopped. The A-D converter is restarted at a selected speed, say 500 hz. It samples for 0.50 sec to provide a pressure baseline and then valve 603 is opened briefly for a specified time, say 0.5 sec, and then re-closed.

A rarefaction wave in the casing is formed. Pressure downstream of valve 603 is ambient pressure, say 30 psi. Pressure upstream of valves 607 and 603 is higher, say 40 psi. When valve 603 is briefly opened, gas rushes from high pressure toward low pressure. Pressure in the flowline is increased slightly and pressure in the annulus is decreased slightly (rarefaction). The A-D converter is running at 500 hz for a pre-selected amount of time to allow the wave to travel to the fluid top and return to the surface. Surge chamber 608 located downstream of valve 603 enhances the rarefaction wave by creating a high inrush of gas from the casing annulus. Speed of sound is known. A good rule of thumb for digitizing (sampling) time is:

$$T_{samp} = T_{base} + \frac{1.1(2L_{pump})}{v} \quad \text{(Eq. 28)}$$

$T_{samp}$ (sec) is sampling time and $T_{base}$(sec) is the brief period for creating the baseline before valve 603 is opened. $L_{pump}$ (ft) is the depth of the pump. v (ft/sec) has already been defined as the speed of sound (pressure wave propagation) in the gas.

The rarefaction wave travels down the annulus, echoes off the fluid top and returns to the surface. When the specified sampling time elapses, the DAM 502 is told to stop the A-D converter and to open valve 603. Normal operation is resumed.

A file of digitized pressures versus time is created in the above process to determine depth of the fluid level echo $L_f$. A time scale is attached knowing the total number of digitized pressure samples and the sampling frequency. A plot of a typical pressure file (see FIG. 7) helps illustrate the process of determining fluid level.

Figure 7:
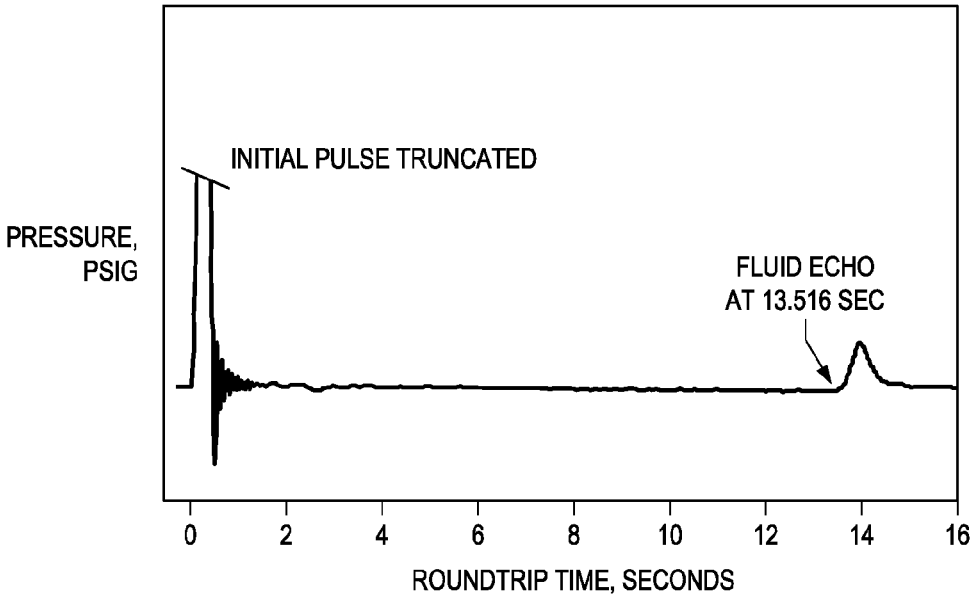
FIG. 7 is a pressure versus roundtrip time graph describing a representative fluid level echo derived using a rarefaction wave.

In the example shown in FIG. 7, the well has its pump set at 7592 ft. The speed of sound in gas is 1101 ft/sec. Sampling (A-D) frequency is 500 hz. In the well of FIG. 7, pressure was sampled for 16.5 sec. This produced 8250 samples [16.5 (500)=8250]. The plot is made with pressure decreasing upward such that a rarefaction wave is plotted upward.

Computer/monitor system 501 'levels-out' the plot versus time in case pressure is increasing or decreasing during the listening period. The baseline at beginning of the record helps to level-out the plot, part of which is shown at left of the pressure trace in FIG. 7. Examination of the digitized data shows the end of the baseline at sample 249. The end of the record is the $8250^{th}$ sample. At 500 hz, we know that time between each sample is 0.002 sec [1/500=0.002]. The end of the baseline is taken to be the origin in time (time=0).

Computer/monitor system 501 also locates the peak of the return signal as designated by its sample number (sample 7006 after the end of the baseline). The computer 'backs down' from the peak to the beginning of the echo signal (sample 6758 after the end of the baseline). The round-trip time of the wave is reckoned from the beginning of the surface disturbance to the beginning of the echo. The round trip time is then:

$$T_{rt}=0.002(6758)=13.516 \text{ sec.}$$

The fluid level is then computed from Equation 27:

$$L_f = \frac{vT_{rt}}{2} = \frac{1101(13.516)}{2} = 7441 \text{ ft from surface.}$$

It is not necessary to shift the time scale. In the original numbering system the beginning of the echo occurred at sample 7007. Then round trip time is 0.002(7007−249)=13.516 sec as computed before.

Figure 6C:
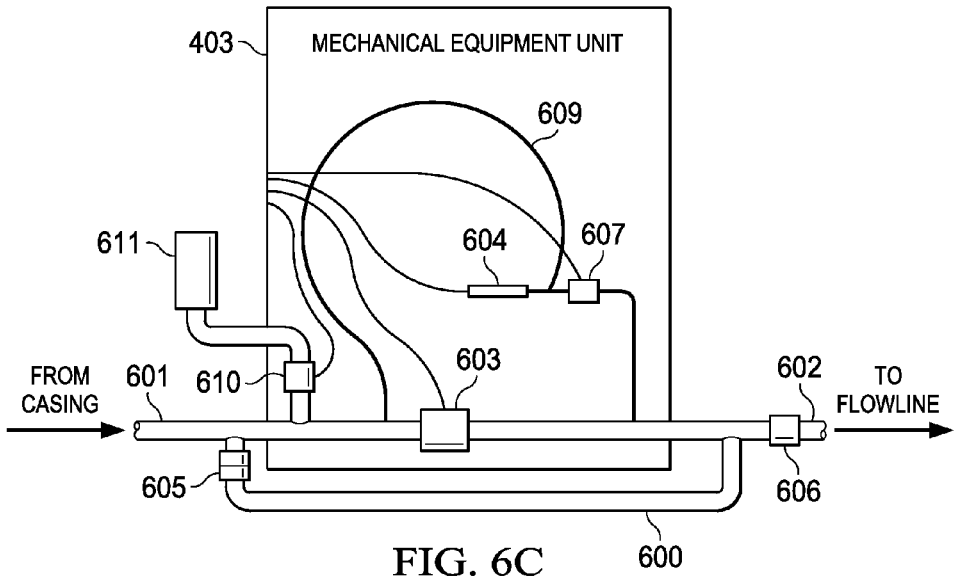
FIG. 6C is a high level functional block diagram of the internal equipment within the mechanical equipment unit shown in FIGS. 4A-4C for an embodiment of the principles of the present invention in which the annular gas volume is inferred, the liquid fluid level is determined with a compression wave, and the speed of sound is measured with pipe organ theory.

Another means for creating an annular wave is shown in the embodiment of FIG. 6C, which uses a surge chamber 611 to store pressure energy. The stored energy causes a compressive wave to be sent down the annulus in search of the fluid level. An additional electric valve 610 is required which is normally closed. Valves 603 and 607 are in their normal state (respectively opened and closed). The process is as follows.

The ambient casing pressure is measured by sampling pressure at 5 hz for one minute. Ambient casing pressure is taken to be the average of these 300 samples. Energy is then stored for creating the compression wave. To store energy, computer/monitor system 501 signals DAM 502 to close valve 603 and open valve 610 and to operate the A-D converter at 1 hz to monitor increase in annulus pressure. When pressure increases a pre-selected amount above ambient pressure, the A-D process is stopped. If the well is shallow, an overpressure of 2 psi might be sufficient to receive an echo from the fluid top in the annulus. If the well is deep or if the annulus is small, a larger overpressure (say 10 psi or more) might be required. Experimentation on a given well will decide the issue of required overpressure.

When the desired overpressure is reached, valve 610 is closed. Then pressure in the annulus is allowed to return to normal by opening valve 603. The A-D converter is restarted at 5 hz to monitor casing pressure. When casing pressure returns to the ambient (normal) value, the A-D converter is stopped and started again at 500 hz. After about 0.5 sec elapses to provide a baseline, valve 603 is closed and valve 610 is opened for about 0.5 sec and then closed. The high pressure gas in surge chamber 611 rushes into the annulus which is at a lower pressure. This sends a compressive wave down the annulus in search of the fluid top. When the sampling time expires, valve 603 is opened to resume normal operation. The computer remembers the pressure sampled during the listening period for the fluid top echo.

Figure 8:
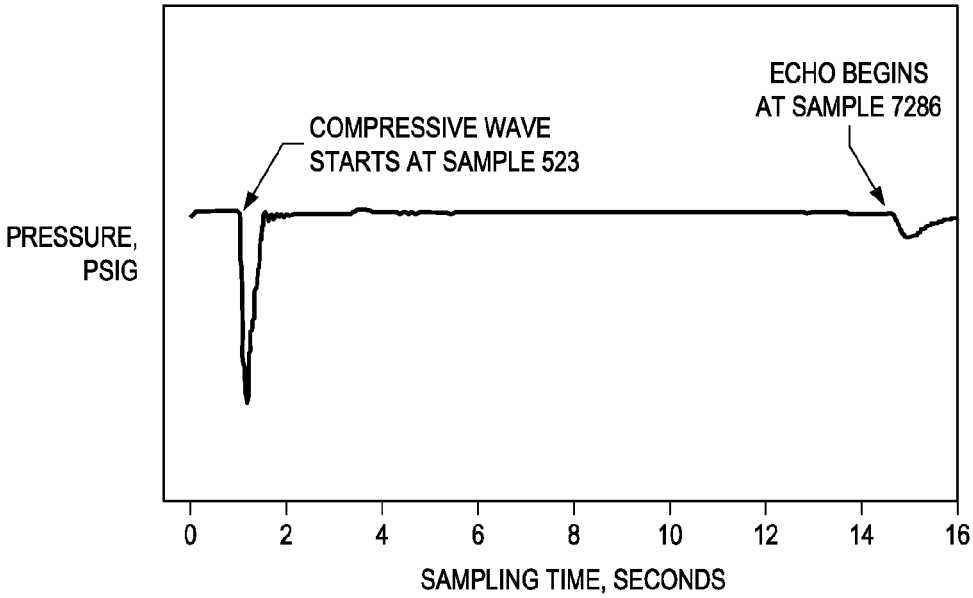
FIG. 8 is a pressure versus sampling time graph describing a representative fluid level echo derived using a compression wave.

FIG. 8 shows a fluid level obtained with the invention by sending a compressive wave down the casing in search of the fluid top. It is the same well used in the description of the rarefaction wave. The compressive wave procedure is also 'green' because no gas is vented to the atmosphere and nothing foreign is injected into the well. Note that the initial impulse and the echo are plotted downward which reveals the compressive nature of the wave, as compared with FIG. 7, which describes the case of a rarefaction wave. The fluid level is found without shifting the time axis as was done in previous example. Computer/monitor system 501 senses when the compressive wave begins (sample 523) and when the echo begins to be received at the surface (sample 7286). Knowing that the samples are 0.002 sec apart (500 hz digitizing rate), we calculate the round-trip time as:

$$T_{rt}=0.002(7286-523)=13.526 \text{ sec.}$$

We calculate the fluid level from Equation 27 as:

$$L_f = \frac{vT_{rt}}{2} = \frac{1101(13.526)}{2} = 7446 \text{ ft from the surface.}$$

This is the same as the fluid level obtained with the rarefaction wave of FIG. 7.

The speed of sound v is required to determine fluid level $L_f$. The preferred way for determining v is from the gas analysis and Equation 14. For validation purposes, three additional methods for determining v are provided according to the principles of the present invention. Note that flexible tube 609 in FIGS. 6B-6C, provides a resonance chamber analogous to a pipe on a pipe organ. Flexible tube 609 is about 25 ft long and is coiled for compactness. Pressure transducer 604 is located near valve 607, which is normally closed. At this position, pressure signals are near maximum. When determining a fluid level, the 604 device 'listens' for the echo through the flexible tube. When speed of sound is being measured, pressure transducer 604 is sensing pressure in the flexible tube 609 so that frequency of the induced wave can be calculated using a Fast Fourier Transform (FFT).

In pipe organs (musical instruments) a stream of air is pumped against the 'edge' of a pipe. A standing pressure wave is created within the pipe whose frequency is determined by the length of the pipe and properties of the air. The pipe responds by vibrating and this creates an audible sound, usually pleasant to the ear. The configuration of FIG. 6B mimics a 'stopped' organ pipe. A stopped pipe has the end closed opposite to the end where to jet of air is impinging on the edge. The pipe can also be open on both ends. If stopped, it sounds a note which is one octave higher than if open on both ends. According to pipe organ theory the fundamental frequency of a standing wave in a stopped organ pipe is $$f = \frac{v}{4L_{c-o}} \quad \text{(Eq. 29)}$$

or $$f = \frac{v}{2L_{o-o}} \quad \text{(Eq. 30)}$$

if open on both ends. f is the fundamental frequency (hz) of the induced pressure wave, L is the effective length of the coiled tubing (ft) and v is the speed of sound in gas (ft/sec). See, for example, Sears, Francis W., Zemanski, Mark W., Young, Hugh D. (1980): College Physics, Addison-Wesley Publishing Company, Reading, Mass., pp. 392-394.

The fundamental frequency of the digitized wave can be determined with Discrete Fourier Transforms (DFTs), particularly the Fast Fourier Transform (FFT) which is very efficient. See for example Embree, Paul M. and Kimble, Bruce (1991): C Language Algorithms for Digital Signal Processing, Prentice Hall, Englewood Cliffs, N.J. 07632, pp. 31-35, 247-257). The length of the tube is clearly delineated on the closed end. On the open end, the length of the tube is less clearly defined. End effects exist which depend upon the size and mechanical properties of the tube. At the open end, changes in flow area cause reflections which influence the effective tube length. See for example FIG. 6B, which shows the point where the flexible tube ties into the pipe coming from the casing just upstream of valve 603.

The pressure wave in flexible tube 609 is created each time a rarefaction wave is created in measuring fluid level. Note the pressure signals in the time interval from 0.5 to 1.5 sec in FIG. 7. The pressure signals damp out quickly because the exciting rarefaction wave is finite in duration as it passes the point where the flexible tube is connected to the casing annulus. In the organ pipe the 'standing' wave is maintained as long as air is pumped by the open edge of the pipe. In the invention, the wave created by passing of the rarefaction wave should not be called a 'standing' wave because of its short duration.

In FFT theory the quantum step of frequency is given by:

$$\Delta f = \frac{s}{2^a} \quad \text{(Eq. 31)}$$

in which Δf is the quantum of frequency (hz), a is the power of 2 that defines the number of samples that are analyzed and s is the sampling (digitizing) frequency (hz). For example in FIG. 7, 4096 samples (a=12) are analyzed and s is 500 hz.

Thus:

$$\Delta f = \frac{s}{2^{12}} = \frac{500}{4096} = 0.122 \text{ hz},$$

which is not particularly good frequency resolution. This suggests that frequency of the induced wave should be determined in a separate experiment from that created in measuring fluid level.

In FIG. 6B, flexible tube 609 is open to the casing annulus and closed at Valve 607. The procedure for measuring speed of sound in the embodiment of mechanical equipment unit 403 shown in FIG. 6B is similar to gathering fluid level data using the rarefaction wave procedure already described.

First, the ambient casing pressure is measured by sampling pressure at 5 hz for one minute. The ambient casing pressure is taken to be the average of these 300 samples.

Next, energy is stored for creating the rarefaction wave. To store energy, computer monitor system 501 signals DAM 502 to close valve 603 and to operate the A-D converter at 1 hz to monitor increase in annulus pressure. When pressure increases a pre-selected amount above ambient pressure, the A-D process is stopped. Since a potentially deep echo off the fluid top is not being sought, the overpressure required will not be as great. Experimentation on a given well will decide the issue of required overpressure.

No pressure baseline is required. When the desired overpressure is reached, the A-D converter is restarted at a higher speed, say 1000 hz. Immediately afterward, valve 603 is opened briefly for a specified time, say 200 millisec, and then re-closed. After a specified sampling time, say 5 sec, the A-D converter is stopped and valve 603 is opened. The shorter sampling time is sufficient to define the induced wave frequency in the flexible tube. No fluid top echo is being sought. A rarefaction wave in the casing is formed. As it passes the flexible tube connection, it induces a wave whose frequency is indicative of V through Equation 29 solved for velocity:

$$v = 4L_{c-o}f \quad \text{(Eq.32)}$$

Apply the FFT process to the collected data. Compute the speed of sound using Equation 32. The accuracy of the computed velocity is higher because of the higher sampling frequency. See Equation 31 again.

Figure 9:
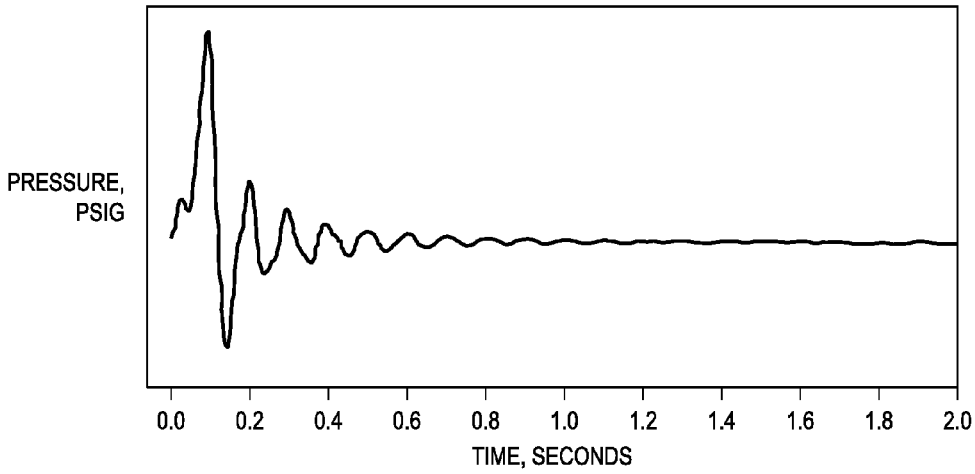
FIG. 9 is pressure versus time graph describing a pressure wave created in a flexible tube for measuring the speed of sound with open-closed pipe organ theory.
Figure 10:
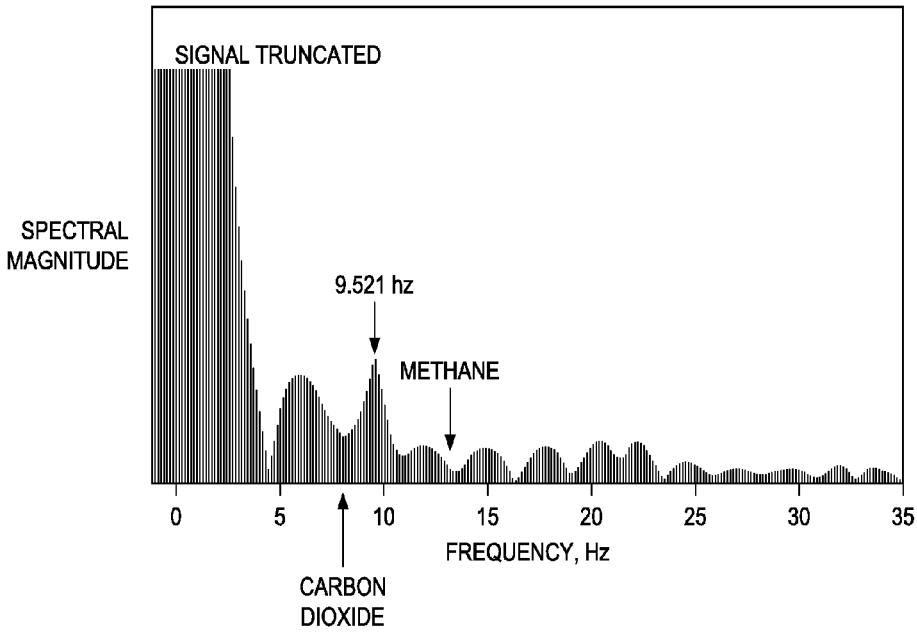
FIG. 10 is a spectral amplitude versus frequency graph showing a Fast Fourier Transform (FFT) spectral analysis of a wave within a open-closed flexible tube.

FIG. 9 shows 2 sec of digitized pressure data from the fluid level file of FIG. 7 after the rarefaction wave passed the point where the flexible tube connects to the casing annulus. In particular, 4096 points of this file were analyzed with the FFT program to obtain the spectrum of FIG. 10. The effective length of the tube is 28.93 ft which was determined from another well in which the speed of sound was known. The spectrum shows many frequencies. The frequency chosen for the induced wave is 9.521 hz. This is known from the properties of the produced gas. If the gas is all methane, it will have a higher speed of about 1500 ft/sec and a frequency about 13 hz. If the gas is comprised entirely of heavy $CO_2$, its speed of sound will be lower, about 900 ft/sec, and its frequency will be about 8 hz. Thus we choose the maximum peak in this range (9.521 hz). Equation 32 relates wave frequency and speed of sound:

$$v = 4L_{c-o}f = 4(28.93)(9.521) = 1102 \text{ ft/sec}$$

which is in good agreement with the known speed of 1101 ft/sec.

Figure 6D:
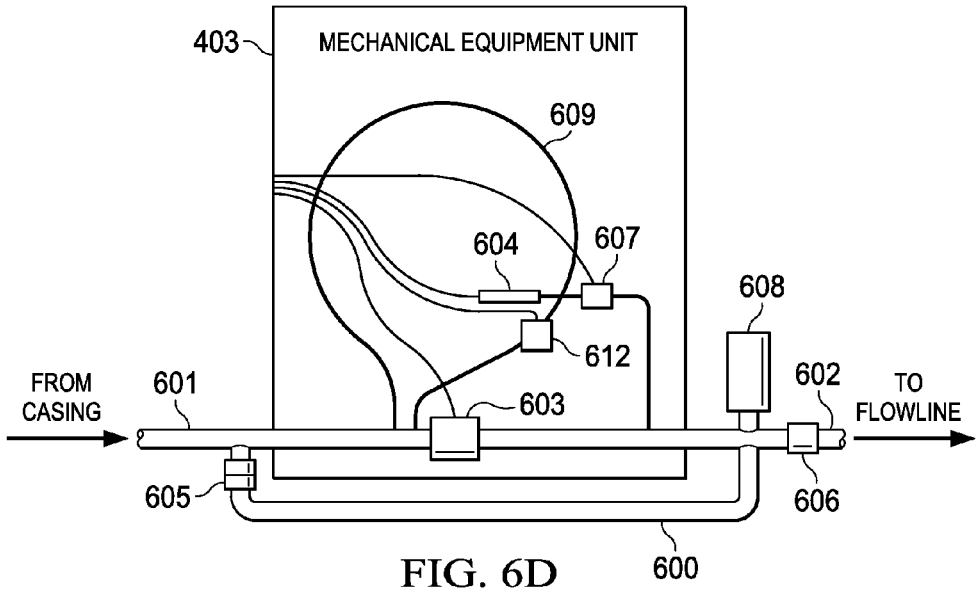
FIG. 6D is a high level functional block diagram of the internal equipment within the mechanical equipment unit shown in FIGS. 4A-4C for an embodiment of the principles of the present invention in which the speed of sound is measured with open-open pipe organ theory.

The invention can also be configured to make the flexible tube behave like a pipe organ which is open on both ends, as shown in FIG. 6D. Another valve 612 is added to the open-closed configuration of FIG. 6B. When gathering data during the open-open experiment, 607 is closed and valve 612 is open. The procedure starts with valves 607 and 612 closed and valve 603 open.

The ambient casing pressure is measured by sampling pressure at 5 hz for one minute. The ambient casing pressure is taken to be the average of these 300 samples.

Energy is stored for creating the rarefaction wave and inducing the wave in the flexible (resonating) tube. To store energy, computer monitor system 501 signals the DAM 502 to close valve 603 and open valve 612 and to operate the A-D converter at 1 hz to monitor increase in annulus pressure. When pressure increases a pre-selected amount above ambient pressure, the A-D process is stopped. Since a potentially deep echo off the fluid top is not being sought, the overpressure required will not be as great. Experimentation on a given well will decide the issue of required overpressure.

No pressure baseline is required. When the desired overpressure is reached the A-D converter is restarted at a higher speed, say 1000 hz. Immediately afterward, valve 603 is opened briefly for a specified time, say 500 millisec sec, and then re-closed. This creates the rarefaction wave which passes both openings of the flexible (resonating) tube inducing a pressure wave therein. After a specified sampling time, say 5 sec, the A-D converter is stopped and valves 603 and 612 are opened and closed, respectively. The shorter sampling time is sufficient to define the induced wave in flexible tube 609. No fluid top echo is being sought. The frequency of the induced wave is indicative of v through Equation 30 solved for velocity:

$$v=2L_{o-o}f \qquad \text{(Eq.33)}$$

The FFT process is applied to the collected data and the speed of sound is computed using Equation 33.

Figure 11:
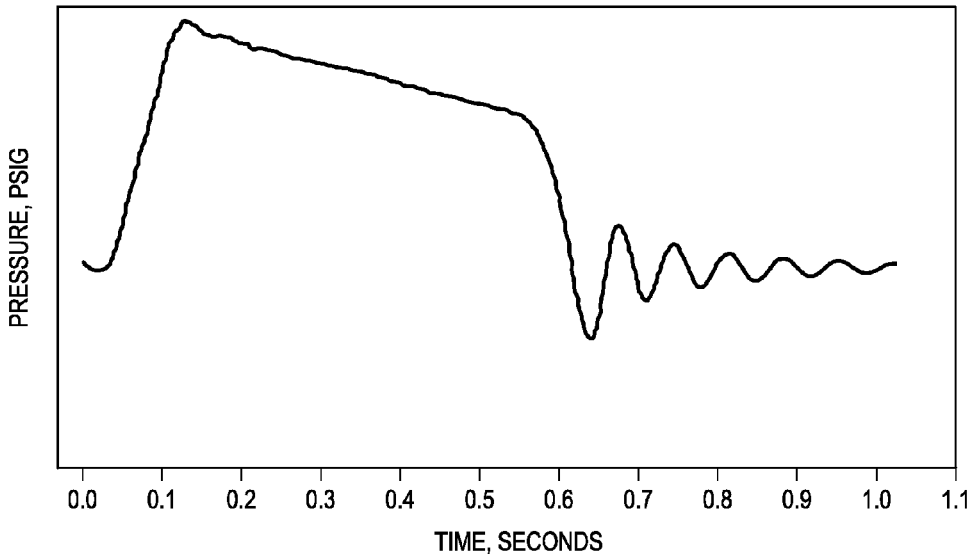
FIG. 11 is a pressure versus time graph showing the pressure created in a flexible tube to measure the speed of sound with open-open pipe organ theory.
Figure 12:
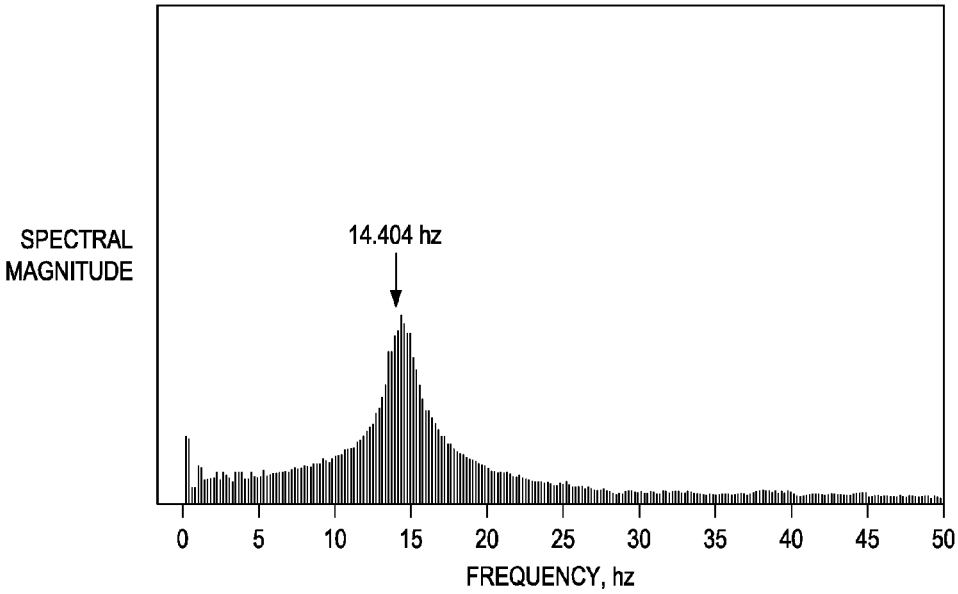
FIG. 12 is a spectral amplitude versus frequency graph showing a Fast Fourier Transform (FFT) spectral analysis of a wave within a open-open flexible tube.

FIG. 11 shows the first 1.024 sec of a file sampled at 1000 hz with flexible tube 609 open on both ends. Rather than FFT the entire file, we remove the rarefaction wave itself and FFT the data starting at about 0.617 sec. This produces the very pure spectrum of FIG. 12. The multiple frequencies shown in FIG. 10 (which require additional logic to select among the several) do not appear. The dominant frequency is 14.404 hz. Like the open-closed case just presented, the open-open configuration has end effects which make its length uncertain. We chose a length of 38.25 ft using pipe organ theory as follows. Set Equations 32 and 33 equal and solve for the open-open length of the resonating tube 609 as $$L_{o-o} = 2L_{c-o}\frac{f_{c-o}}{f_{o-o}}$$

into which we use the results from the closed-open application $$L_{o-o} = 2(28.93)\frac{9.521}{14.404} = 38.25 \text{ ft.}$$

The speed of sound determined from open-open pipe organ theory is from Equation 33 $v=2L_{o-o}f=2(38.25)(14.404)=1102$ ft/sec, again in good agreement with the known speed of 1101 ft/sec.

Figure 6E:
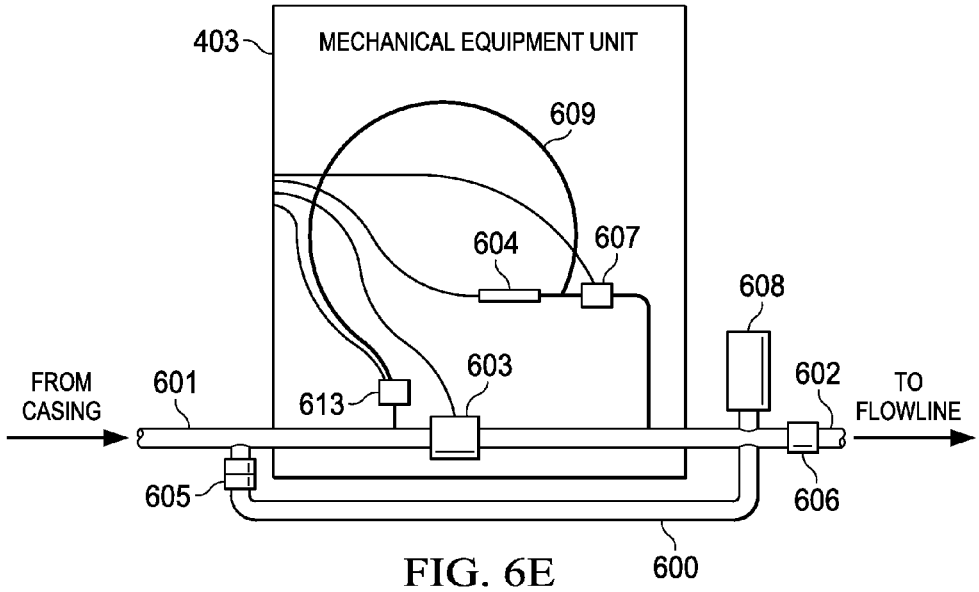
FIG. 6E is a high level functional block diagram of the internal equipment within the mechanical equipment unit shown in FIGS. 4A-4C for an embodiment of the principles of the present invention in which the speed of sound is measured with trapped gas.

A fourth way of measuring speed of sound with the inventive principles uses gas trapped between two closed valves, as shown in FIG. 6E. In this case there are no end effects that make the effective length of flexible tube 609 uncertain. The length is very definite, i.e. the measured distance between closed valves 607 and 613 of FIG. 6E. The procedure for gathering data begins with valves 603 and 613 open and valve 607 closed.

The ambient casing pressure is measured by sampling pressure at 5 hz for one minute. The ambient casing pressure is taken to be the average of these 300 samples.

Energy is stored for determining the speed of sound using trapped gas in the flexible (resonating) tube 609 of known length as follows. To store energy, computer/monitor system 501 signals DAM 502 to close valve 603 and to operate the A-D converter at 1 hz to monitor increase in annulus pressure. When pressure increases a pre-selected amount above ambient pressure, the A-D process is stopped. Since an echo off the fluid top is not being sought, the overpressure required will not be as great. Experimentation on a given well will decide the issue of required overpressure.

No pressure baseline is required. When the desired overpressure is reached, Valve 613 is closed and valve 603 is opened. Enough time is allowed for casing pressure to return to normal. This amount of time must be determined experimentally since the A-D converter can not sense casing pressure because valve 613 is closed.

The A-D converter is restarted at a higher speed, say 1000 hz. Immediately afterward, valve 607 is opened briefly for a specified time, say 20 millisec sec, and then re-closed. After a specified sampling time, say 5 sec, the A-D converter is stopped and valve 613 is opened. The shorter sampling time is sufficient to define the wave frequency of the trapped gas in the flexible tube. The same form of the equation relating speed of sound to frequency in the open-open pipe organ experiment is used:

$$v=2L_{trap}f \qquad \text{(Eq.34)}$$

The FFT process is applied to the collected data collected and the speed of sound is calculated using Equation 34.

Figure 13:
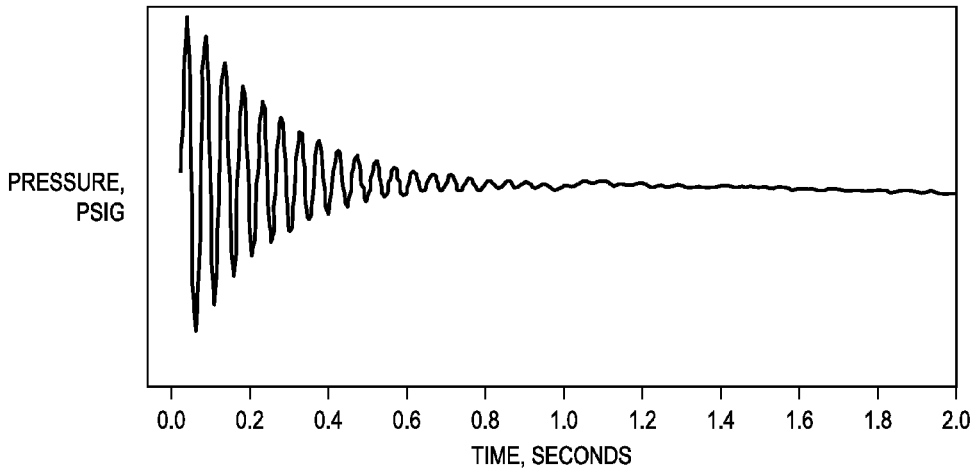
FIG. 13 is a pressure versus time graph showing a wave created in a flexible tube for measuring the speed of sound in trapped gas.
Figure 14:
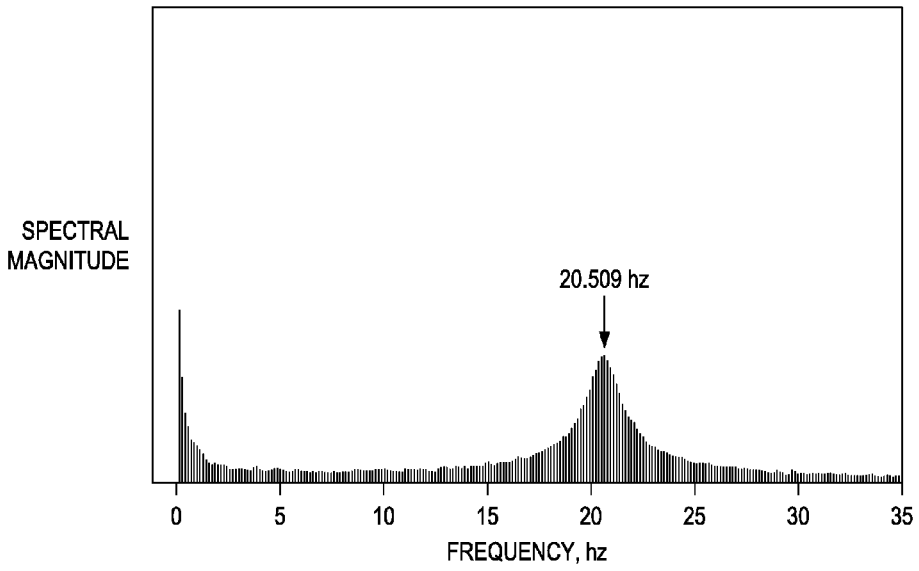
FIG. 14 is a spectral amplitude versus frequency graph showing a Fast Fourier Transform (FFT) spectral analysis of a wave within a trapped gas.

FIG. 13 shows the first 2 sec of data gathered in the trapped gas experiment. The FFT spectrum of the wave is shown in FIG. 14. The wave contains only one pertinent frequency of 20.509 hz. Equation 34 is used to compute speed. The measured distance between closed valves 607 and 613 is 25.41 ft so $$v=2L_{trap}f=2(25.41)(20.509)=1142 \text{ ft/sec.}$$

This compares with the speed of sound of 1131 ft/sec obtained from other considerations. It is important to note that liquid that can accumulate in the flexible (resonating) tube must be purged before the tube is used in any way to determine speed of sound v. This includes closed-open and open-open pipe organ theory and trapped gas. This purging is accomplished as follows. First energy is stored by closing valve 603 and monitoring pressure until a small overpressure, say 2 psi, is obtained. Then liquid is purged by opening valve 607 for about 15 sec and then re-closed. If liquids are not purged, the frequencies in the flexible (resonating) tube can be affected. Also purging of liquid should not be done in connection with determining fluid level because it increases flowline pressure. This decreases the difference between casing and flowline pressure such that a wave strong enough to reveal the fluid top may not be created. Purging once each day under computer control between build-up measurements should be adequate.

Figure 1C:
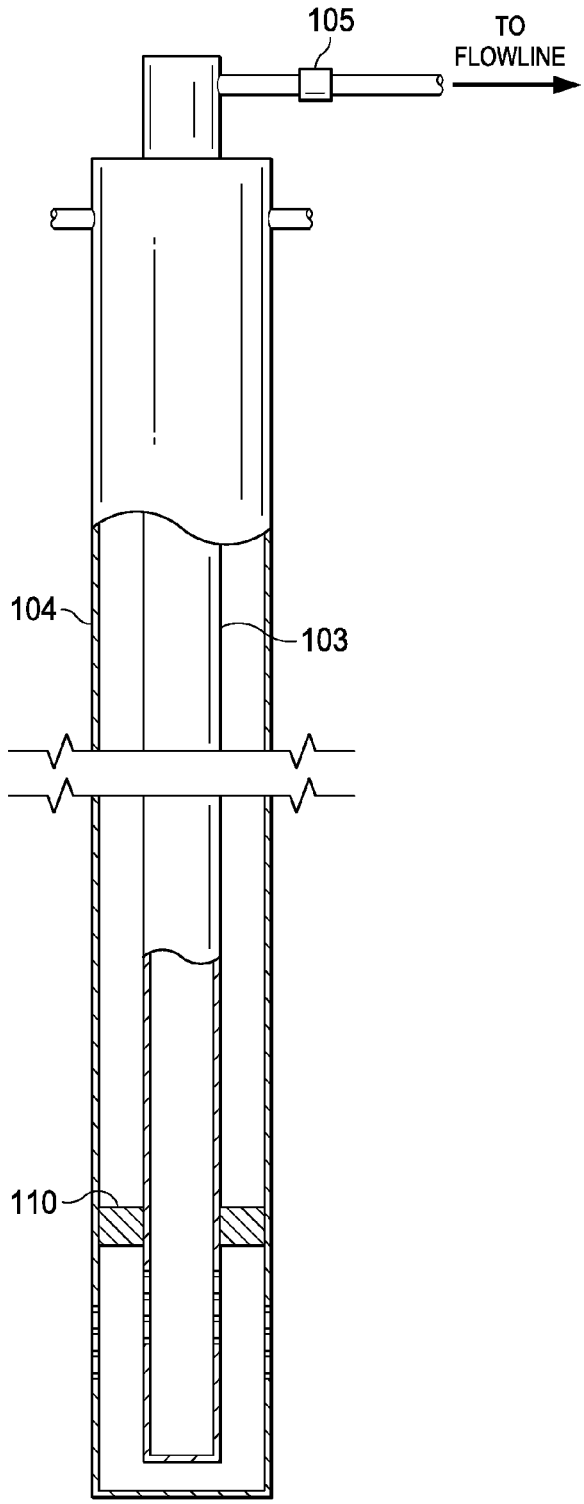
FIG. 1C (PRIOR ART)
FIG. 1C is a diagram of a portion of a typical pure gas well.
Figure 15:
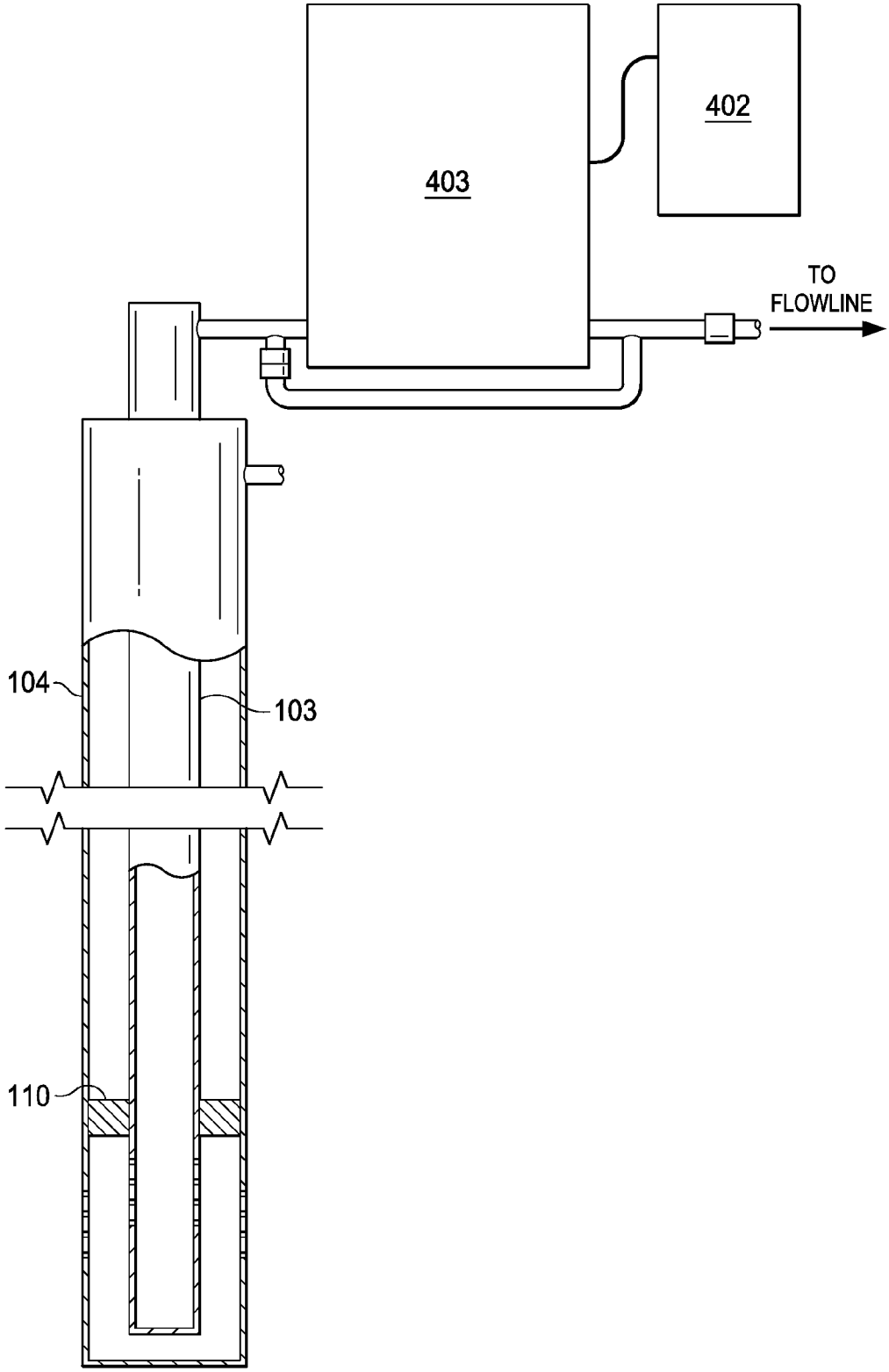
FIG. 15 shows a representative application of the present inventive gas inference principles in a pure gas well.

The principles of the present invention also apply to pure gas wells which produce little or no liquid (FIG. 1C). These wells do not require artificial lift. Reservoir pressure is sufficient to push gas to the surface naturally. A typical pure gas well configured according to the present invention is shown in FIG. 15. A packer 110 is set which seals the casing-tubing annulus and forces all of the gas to pass up tubing 103. Fluid level is not required in this case to compute gas volume V, which is instead readily calculated from casing and tubing sizes, tubular length and packer depth:

$$V = \frac{\pi}{4(144)}[L_t d_{tid}^2 + (L_c - L_t)d_{cid}^2 + (L_t - L_{pkr})(d_{cid}^2 - d_{tod}^2)] \quad \text{(Eq. 35)}$$

The formula for gas temperature at entry point needs revision as:

$$T_b = 460 + 0.01\nabla_t L_{perf} \quad \text{(Eq. 36)}$$

Another example will illustrate the application of the present inventive principles to pure gas wells. In this example, produced gas is being inferred in a pure gas well. 2.375 in. tubing is set at 5000 ft ($L_t$). 4.5 in. casing is set at 5100 ft ($L_c$). A packer is set at 4950 ft ($L_{pkr}$). Average perforation depth is 4975 ft ($L_{perf}$). Other pertinent information is:

Casing internal diameter, $d_{cid}$: 4 in.

Tubing outer diameter, $d_{tod}$: 2.375 in.

Tubing internal diameter, $d_{tid}$: 1.995 in.

k: 1.150 (computed from gas analysis).

Pressure buildup rate, dp/dt: 3.47 psi/min (measured with pressure transducer).

Geothermal temperature gradient, $\nabla_t$: 1.0 deg F./100 ft.

Specific gravity of gas, G: 0.843 (computed from gas analysis).

z=0.98 (computed from Dake, L. P. (1978): *Fundamentals of Reservoir Engineering, Elsevier Science*, Amsterdam, pp. 19-20.).

Solution:

$$T_b = 460 + 0.01(1.0)(4975) = 510 \text{ deg } R \quad \text{(Equation 36)}$$

$$V = \frac{\pi}{4(144)}[5000(1.995^2) + (5100 - 5000)4^2 + (5000 - 4950)(4^2 - 2.375^2)] = V = 120.1 \text{ ft}^3 \quad \text{(Equation 35)}$$

$$M = 0.843(28.96) = 24.41 \quad \text{(Equation 4)}$$

$$R = \frac{1544}{24.41} = 63.25 \quad \text{(Equation 6)}$$

From Equation 8d, the solution is:

$$mcf/d = \frac{79004 \text{ kV}}{zMRT_b}\frac{dp}{dt} = \frac{79004(1.15)(120.1)}{0.98(24.41)(63.25)(510)}(3.47) = 49.068\ mcf/d$$

Note that the calculated volume of gas from Equation 35 is contained inside the well tubulars. Gas wells are sometimes hydraulically fractured to create void spaces near (but outside) the wellbore. This improves the productivity of the well. If fracturing is involved, it may be necessary to 'calibrate' the process at initial setup. The process is: (1) compute mcf/d from Equations 8d and 20 (or 22) over a period of time in the usual manner; and (2) using a portable orifice meter apparatus, measure the actual mcf/d during the same period of time.

The calculated results in Step 1 may not agree with measurements in Step 2. A source of error is the temperature gradient which is difficult to determine accurately. Other small errors in input data may exist together with small errors in measuring dp/dt. If the rate inferred in Step 1 above is slightly less than measured in Step 2, the discrepancy is likely due to minor input data errors. If, however, the rate measured in Step 2 is about 10 percent or more than inferred in Step 1, the cause is likely that exterior volume has been created by fracturing the well. In this case the calculated volume V should be increased by the fracture factor:

$$f_f \frac{mcf_{measured}}{mcf_{inferred}} \quad \text{(Eq. 37)}$$

For example if the above ratio is 1.25, the volume computed with Equation 35 should be increased to 150.125[1.25 (120.1)=150.125]. Thereafter the inferred rate should be computed with V=150.125 $ft^3$ in Equation 8d. Still later the measured rate and inferred rates might be compared again. If the effective volume is decreasing substantially, it is probable that the fractures are closing-up and a re-fracturing should be considered.

FIG. 15 shows the invention applied to infer gas production in a pure gas well. Mechanical equipment unit 403 in FIG. 15 does not need the fluid level capability. Preferably a simplified embodiment of mechanical equipment unit 403 shown in FIG. 6A is utilized for a pure gas well.

Figure 16:
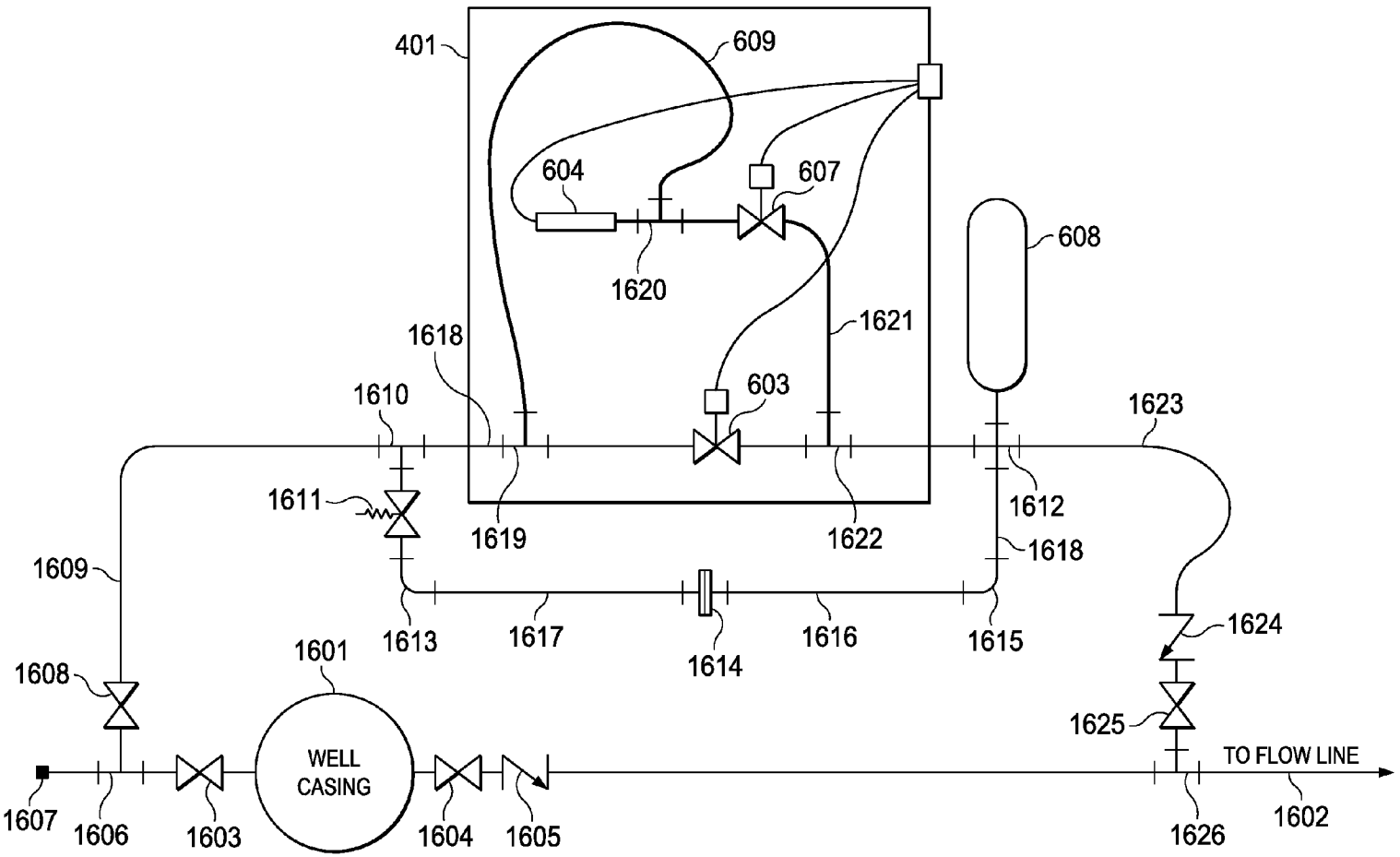
FIG. 16 illustrates the mechanical equipment unit of FIG. 6B when connected to a well under test.

The principles of the present invention provide several capabilities for accomplishing its purpose for which certain items of equipment are required. For example, FIG. 6B shows an embodiment, which accomplishes all of the purposes of the invention (inferring gas rate, determining fluid level, and measuring the speed of sound) with a minimum of equipment. FIG. 16 shows the embodiment of FIG. 6B tied into a typical wellhead.

In FIG. 16, equipment components are described as gas leaves the casing annulus 1601, passes through the gas inferring equipment and enters the flowline 1602. All fittings are extra heavy seamless steel with national pipe threads (NPT).

Manually operated Valves 1603 and 1604 and check valve 1605 are typically part of the existing wellhead. A 2 in. by 6 in. nipple and 2 in. tee 1606 screwed into the 2 in. casing outlet valve 1603. A 2 in. plug 1607 is screwed into one outlet of tee 1606. Removal of the plug allows access into the casing annulus for measuring fluid levels and for treating the well for paraffin, corrosion, scale etc. A 2 by 1 in. bushing and a 1 by 4 in. nipple (not shown) are screwed into the other outlet of tee 1606

A 1 in. ball valve 1608 from Grainger (Item No. 1CKD3, 600 psi WOG working pressure) is installed on the nipple. This valve serves to isolate the gas measurement system from the well should access to the casing annulus become necessary for fluid level measurements and well treatments.

A 1 in. by 10 ft long high pressure hose 1609 from Midwest Hose (Part No. 42516-116-616, 2400 psi reinforced wire braid with male swivel screwed ends) is used to connect the ball valve 1608 outlet to a 1 in. screwed tee 1610.

A 1 in. pressure relief valve 1611 from Grainger (Item No. 3ETF8, 125 psi setting, male NPT inlet/female NPT outlet) is screwed into one of the outlets of 1610. The purpose of relief valve 1611 is to bypass gas around the gas measuring equipment should valve 603 inadvertently remain closed (see also valve 605 of FIG. 6B).

The bypass section leads to a 1 in. cross 1612 as follows. A 1 in. by 6 in. nipple is screwed into the outlet of relief valve 1611 thence to a 1 in. ell 1613 thence to a 1 in. by 6 in. nipple 1617 thence to a 1 in. union 1614 thence to a 1 in. pipe 1616 cut to proper length for assembly thence to ell 1615 thence to a 1 in. nipple 1618 cut to proper length for assembly and thence to cross 1612 downstream of the gas measurement section.

The other outlet of tee 1610 routes gas through gas measuring equipment with a 1 in. by 4 in. nipple 1618 connected to another 1 in. tee 1619. A 1 in. by ¼ in. bushing (not shown) is screwed into the vertical outlet of tee 1619. A ⅜ in. by 25 ft high pressure hose 609 from Parker (Parflex Hose No. 520N-6, 3000 psi with ¼ in. male swivel screwed ends) is connected to the bushing. Hose 609 is coiled with a diameter of approximately 1 ft to minimize space requirements. As discussed above, hose 609 serves as a resonating pipe for measuring the speed of sound in the produced gas based on open/closed pipe organ theory.

The outlet of hose 609 is connected to a ¼ in. tee 1620. Pressure transducer 604 with male ¼ in. threads from Stellar Technology (Series GT 1800, 100 psi pressure rating, 8-18 v d-c excitation, 0-5 v d-c output) is screwed into one outlet of tee 1620. As discussed above, pressure transducer 604 senses pressure data for determining buildups, fluid levels and speed of sound. The pressure rating of transducer 604 depends on the anticipated surface producing casing pressures.

A ¼ in. female automatic valve 607 from Skinner Valve (Direct Acting Electric Valve, Part No. 71215SN2EN00, 12 v d-c, 450 psi, normally closed) is installed in the remaining outlet of tee 1620 with a ¼ in. by 1½ in. nipple (not shown). Normally closed valve 607 can be opened for a short time, say about 15 seconds, to purge the coiled hose of liquids as previously described. A short ⅜ in. by 1 ft hose 1621 from Parker Parflex with the same specifications as hose 609 is connected to the outlet of valve 607.

The outlet of hose 1621 is connected to a 1 in. tee 1622 using a 1 in. by ¼ in. bushing (not shown). A 1 in. female automatic valve 603 from Skinner Valve (Pilot Operated Electric Valve, Part No. 73222BN63N00, 12 v d-c, 200 psi, normally open) is connected to outlet of tee 1619 with a 1 in. by 4 in. nipple. As discussed above, the function of this normally open valve is to close for pressure buildups and to shoot fluid levels by opening and closing abruptly.

The outlet of valve 603 is connected to tee 1622 with a 1 in. by 4 in. nipple. The other outlet of tee 1622 is connected to cross 1612 with a 1 in. nipple of appropriate length. This nipple length is selected to position sensitive equipment inside the steel enclosure.

A surge chamber 608 with a 1 in. male thread is connected into the upward outlet of cross 1612. The purpose of the surge chamber (volume of about 1.5 cu ft) is to create a stronger fluid level shot by a high inrush of gas. Other types of surge chambers or vessels can be used. A 1 in. by 10 ft hose 1623 (same as hose 1609), is connected to the remaining outlet of cross 1612. The outlet of hose 1623 is screwed into a 1 in. check valve 1624 from Grainger (Part No. 1JLX9, Y pattern, swing type, 600 psi WOG). A 1 in. by 4 in. nipple is used to connect check valve 1624 to a 1 in. ball valve 1625 with same specifications as ball valve 1608. A 1 in. by 4 in. nipple and 1 in. by 2 in. bushing (not shown) are used to connect valve 1625 to a 2 in. tee 1626 installed in flow-line 1602.

After installing all gas measuring equipment and with the well producing normally gas is routed through the measuring equipment by opening valves 1603, 1608, and 1625 and by closing valve 1604.

The physical structure for mechanical equipment unit 403 is a pole mounted steel enclosure from Consolidated Electrical Distributors (Austin Part No. AB20208WL, 20 in. high by 20 in. wide by 8 in. deep) and is used to house the automatic valves, pressure transducer and ⅜ in. coiled hose. A weather tight electrical connector (EC) is installed to connect electric control and data cables from mechanical equipment unit 403 to a pole mounted electrical equipment unit 402 that is located near the pumping unit motor control panel.

The invention was perfected and tested with a version of electrical equipment unit 402, which contains the power supply 503 (12 v d-c, Model Awsp60-12; Mfgr. Triad), data acquisition module 502 (Model #9816; Mfgr. Datatranslation), relays 504 (Model DC60S3-B; Mfgr. Crydom), and computer/monitor system 501. See FIG. 5. It is preferably pole mounted and constructed of fiberglass (Item No. J1816HPL, 18 in. by 16 in. by 8 in.; from ESI Supply). Electrical equipment unit 402 is located near the pumping unit motor control box and connected to mechanical equipment unit 403 with buried electrical cable in conduit. The invention was perfected and tested with a Latitude/D610 laptop computer; Mfgr. Dell.

Production models of electrical equipment unit 402 will preferably employ a dedicated microcomputer chip with A-D and I/O capability (Mfgr: Intel). The monitor will be a Liquid Crystal Display mounted on the outside of Enclosure 403 (Mfgr: Microtips). Electrical equipment unit 402 for the production model can be much smaller, say like those made by Stahlin. If the principles of the present invention are applied to pure gas wells or engine driven artificially lifted wells, electrical power would be supplied with solar collectors (Mfgr: Atlantic Solar Products, Inc).

Figure 17:
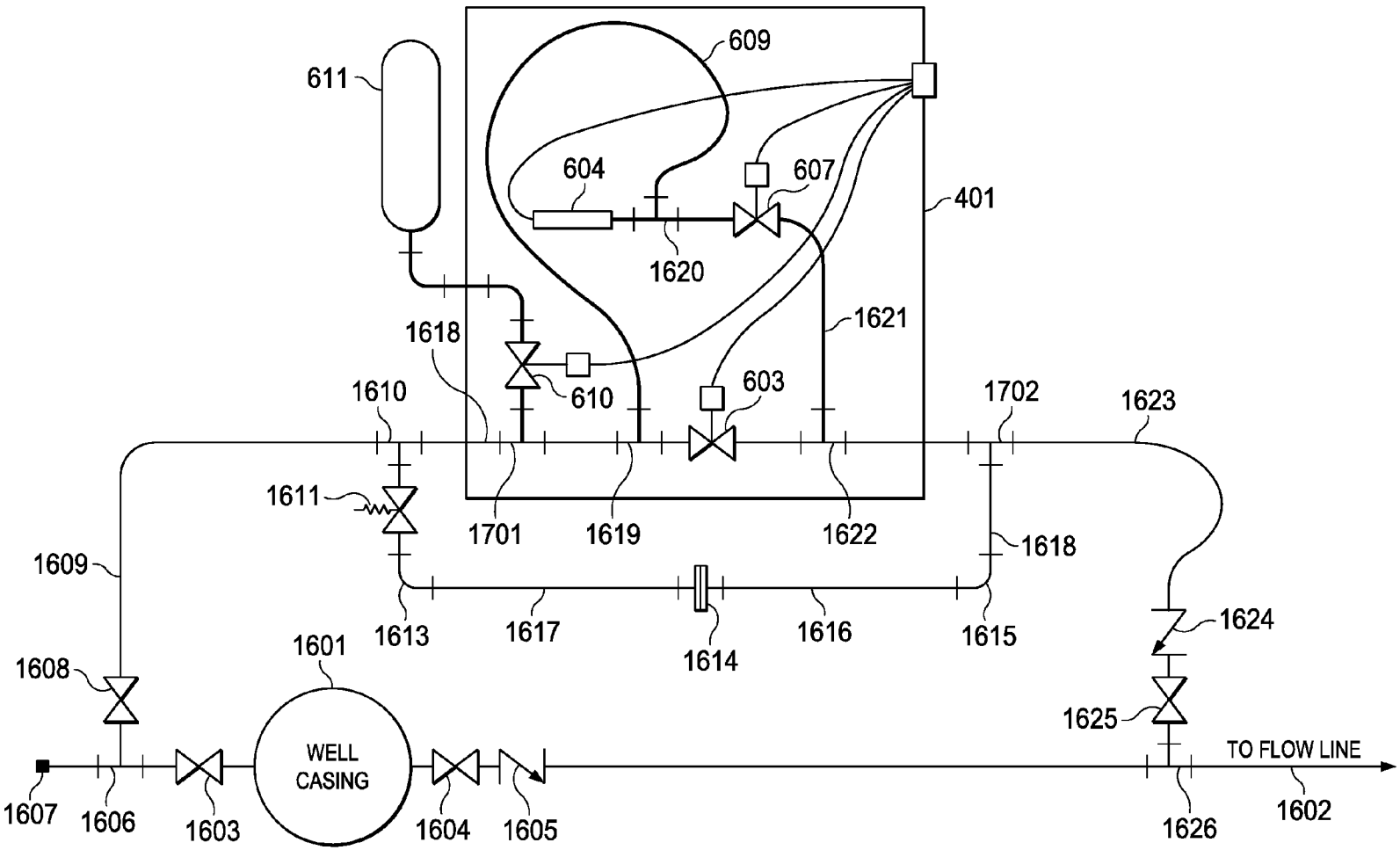
FIG. 17 illustrates the mechanical equipment unit of FIG. 6C when connected to a well under test.

The preferred embodiment just described has all features required to accomplish the purposes of the invention. However in special cases it might be desirable to incorporate other or additional features. FIG. 17 illustrates equipment for creating a compressive wave for shooting a fluid level if desired, also discussed above.

As shown in FIG. 17, another 1 in. tee 1701 is installed inside the enclosure between tee 1610 and tee 1619. In the vertical outlet of tee 1701, valve 610 is installed, which is preferably a Skinner Pilot Operated Electric valve, No. 73212BN63N00, 12 v d-c, 300 psi, normally closed. Then with nipples and ells surge chamber 611 is provided upstream of valve 603. Cross 1612 of FIG. 16 is replaced with a 1 in. tee 1702. This new configuration provides capability for creating a compressive wave.

Figure 18:
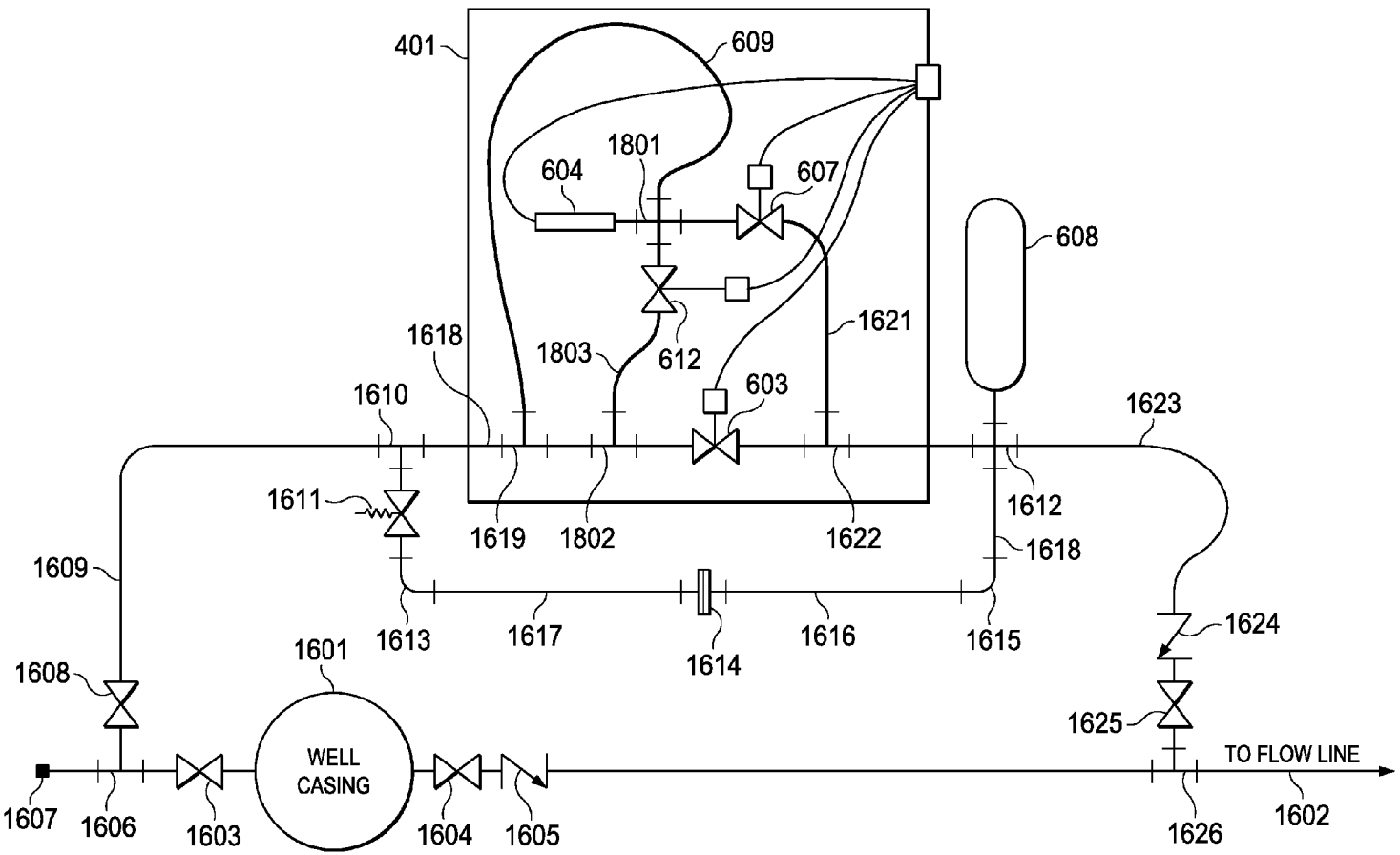
FIG. 18 illustrates the mechanical equipment unit of FIG. 6D when connected to a well under test.

FIG. 18 illustrates a configuration to measure speed of sound with open-open pipe organ theory. This embodiment utilizes a cross 1801 between valve 607 and pressure transducer 604. In the downward outlet of cross 1801 is installed valve 612, which preferably is a Skinner Pilot Operated electric valve No. 73212BN2MN00, ¼ in. female NPT, ¼ in. orifice, 300 psi, normally closed. A 1 in. tee 1802 is installed between valve 603 and tee 1619. A ⅜ in. hose 1803 connects valve 612 into tee 1802 with a 1 in. by ¼ in. bushing. This provides capability for measuring speed of sound using open-open pipe organ theory.

Figure 19:
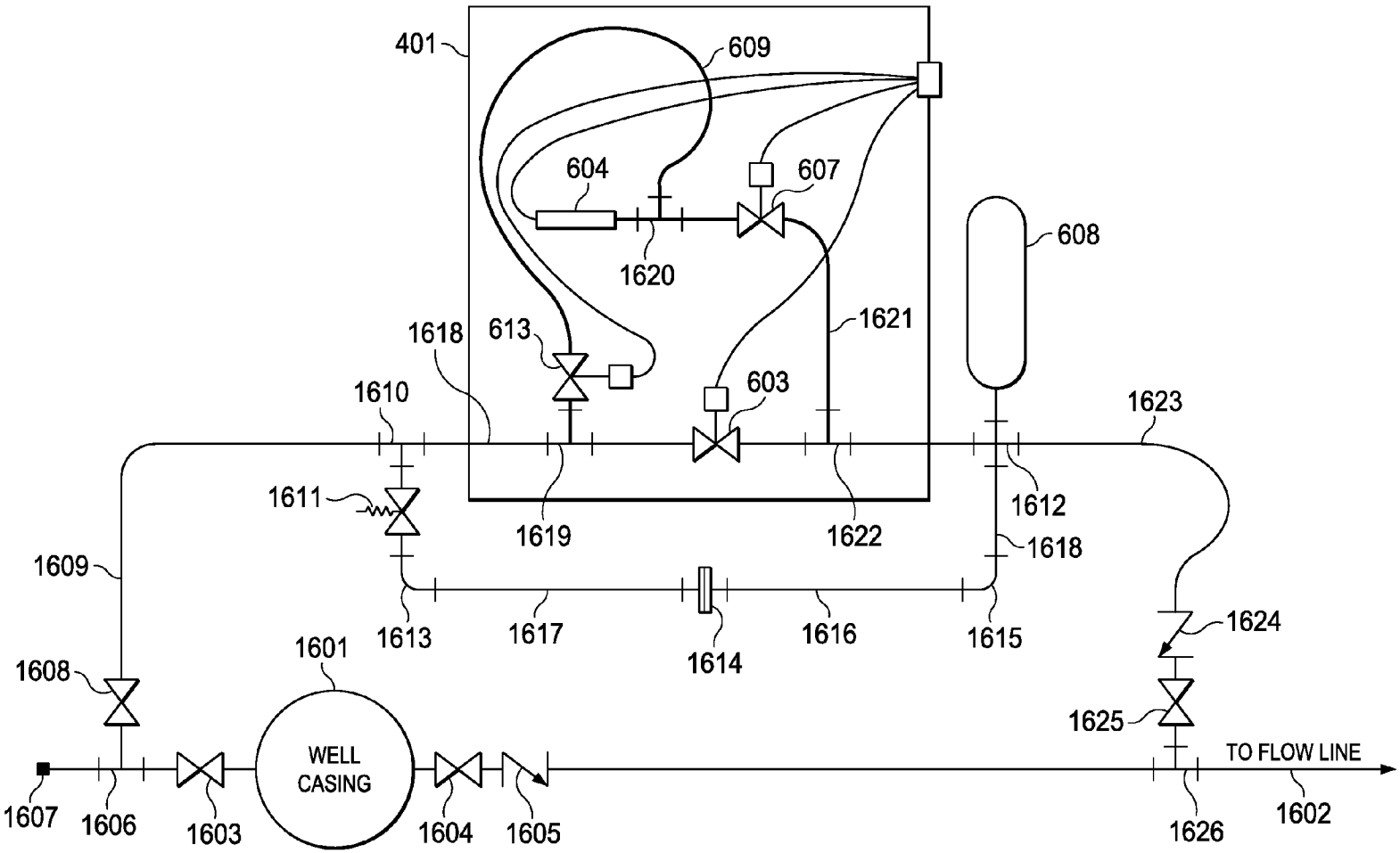
FIG. 19 illustrates the mechanical equipment unit of FIG. 6E when connected to a well under test.

FIG. 19 illustrates a configuration for measuring the speed of sound from trapped gas, described in detail above. In this embodiment, valve 613 is a Skinner Direct Acting No. 7122 KBN2GF00, ¼ inch female NPT, 435 psi, normally-open electric valve connected to tee 1619. The outlet of valve 613 is connected to hose 609. This provides capability for measuring speed of sound using trapped gas.

Inferring production of oil and gas wells lifted with rod pumping equipment is the subject of U.S. Pat. No. 7,212,923, issued May 1, 2007 to Gibbs and Nolen for Inferred Production Rates of a Rod Pumped Well from Surface and Pump Card Information ("the 923 Patent"). The '923 Patent discloses a system that uses the downhole pump to 'meter' volumes of oil, water and gas passing up the tubing. Using data acquired at the surface, the wave equation of mathematical physics is used to calculate a downhole pump dynamometer card, the shape of which reveals the amount of oil, water and gas passing through the pump into the tubing. Good production practice diverts (as much as possible) of the free gas up the annulus. Venting free gas up the annulus rather than having it pass through the pump increases volumetric efficiency of the pump.

In contrast, the principles of the present invention, infer the gas production passing through the annulus. The process described in the '923 Patent only senses gas passing through the tubing and has no sense of the gas passing through the annulus.

Determining fluid level in oil and gas wells is the subject of many patents, including U.S. Pat. No. 5,715,890, which issued to Nolen on Feb. 10, 1998 for *Determining Fluid Levels in Wells With Flow Induced Pressure Pulses* ("the '890 Patent"). The '890 Patent discloses a method for measuring the speed of sound in a coil of tubing of known length by measuring the roundtrip time of an induced rarefaction wave. The fluid level is sensed by measuring the round trip time of a wave created by venting a small amount of gas to the atmosphere or injection of a foreign substance into the well. In other words, the system of the '890 Patent pollutes the atmosphere and creates a safety hazard, since compressed gas from an external source is used to create a compressive wave or a rarefaction wave is created by venting which pollutes.

In contrast, according to the principles of the present invention, the fluid level is determined using the well's own energy in a non-polluting fashion.

U.S. Pat. No. 4,934,186, issued Jun. 10, 1990 to McCoy for Automatic Echo Meter, determines the speed of sound in gas by timing minute pressure reflections from tubing collars a known distance apart. The fluid level is sensed by measuring the round trip time of a compressive wave created by discharging high pressure gas into the casing. In contrast, the principles of the present invention measure fluid levels using well supplied energy rather than energy from an external source.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same processes and purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

APPENDIX 1

TABLE 1

Comparison of inferred rates versus actual measurements on stable well.

| Time of Day | Equation 8d (mcf) | Orifice Meter (mcf) |
|---|---|---|
| 9:00-10:00 | 1.493 | 1.451 |
| 10:00-11:00 | 1.499 | 1.517 |
| 11:00-12:00 | 1.574 | 1.558 |
| Totals: | 4.566 | 4.526 |

TABLE 2

Typical gas analysis showing molecular weights and $MC_p$ values.

| | Mol % | MolWt | $MC_p$ @ 150 deg F. |
|---|---|---|---|
| Hydrogen sulfide | 0.00 | 34.08 | 8.269 |
| Nitrogen | 3.33 | 28.01 | 6.963 |
| Carbon dioxide | 0.21 | 44.01 | 9.288 |
| Methane | 62.44 | 16.04 | 8.970 |

TABLE 2-continued

Typical gas analysis showing molecular weights and $MC_p$ values.

| | Mol % | MolWt | $MC_p$ @ 150 deg F. |
|---|---|---|---|
| Ethane | 11.91 | 30.07 | 13.780 |
| Propane | 11.25 | 44.1 | 19.580 |
| Iso-butane | 1.10 | 58.12 | 25.820 |
| Nor-butane | 4.21 | 58.12 | 26.160 |
| Iso-pentane | 1.11 | 72.15 | 32.200 |
| Nor-pentane | 1.29 | 72.15 | 32.390 |
| Hexanes | 1.65 | 86.18 | 38.700 |
| Heptanes+ | 1.50 | 100.2 | 45.000 |

TABLE 3

Typical daily gas production report
Company A
Well No. 1

| Time | Volume (mcf) | Date |
|---|---|---|
| 00:00 to 01:00 | 0.769 | Oct. 23, 2009 |
| 01:00 to 02:00 | 0.804 | Total Production |
| 02:00 to 03:00 | 1.041 | mcf/d |
| 03:00 to 04:00 | 1.245 | 30.249 |
| 04:00 to 05:00 | 1.392 | |
| 05:00 to 06:00 | 1.518 | |
| 06:00 to 07:00 | 1.517 | |
| 07:00 to 08:00 | 1.576 | |
| 08:00 to 09:00 | 1.604 | |
| 09:00 to 10:00 | 1.451 | |
| 10:00 to 11:00 | 1.517 | |
| 11:00 to 12:00 | 1.558 | |
| 12:00 to 13:00 | 1.667 | |
| 13:00 to 14:00 | 1.154 | |
| 14:00 to 15:00 | 1.631 | |
| 15:00 to 16:00 | 1.530 | |
| 16:00 to 17:00 | 1.303 | |
| 17:00 to 18:00 | 1.170 | |
| 18:00 to 19:00 | 1.279 | |
| 19:00 to 20:00 | 1.188 | |
| 20:00 to 21:00 | 0.964 | |
| 21:00 to 22:00 | 0.822 | |
| 22:00 to 23:00 | 0.844 | |
| 23:00 to 00:00 | 0.705 | |

APPENDIX 2

Nomenclature

| | | |
|---|---|---|
| $AG_i$ | allocated gas to well i | mcf |
| a | exponent | — |
| b.oil | barrels of oil | b |
| DAM | data acquisition module used to digitize data and control electrically operated valves | — |
| $d_{cid}$ | casing internal diameter | in. |
| $d_{tod}$ | tubing outside diameter | in. |
| f | frequency | hz |
| $f_i$ | allocation factor for well i | — |
| $f_f$ | fracture factor | — |
| G | specific gravity of gas referred to air | — |
| $IC_i$ | inferred casing gas from well i using the invention | mcf |
| i | subscript | — |
| k | ratio of specific heats | — |
| $L_f$ | fluid level depth from surface | ft |
| $L_{pump}$ | pump depth | ft |
| $L_{trap}$ | length of flexible tube between closed valves | ft |
| $L_{pkr}$ | packer depth from surface | ft |
| $L_c$ | casing length | ft |
| $L_t$ | tubing length (setting depth) | ft |

-continued

| Nomenclature | | |
|---|---|---|
| $L_{perf}$ | average depth of casing perforations | ft |
| $L_{o-c}$ | length of flexible tube (open-closed) | ft |
| $L_{o-o}$ | length of flexible tube (open on both ends) | ft |
| M | time between pressure buildup samples | min |
| M | molecular weight | $lb_m$ |
| $Mc_p$ | molal heat capacity | btu/$lb_m$-deg F. |
| mcf | thousand standard cu ft | $ft^3$ |
| mmcf | million standard cu ft | $ft^3$ |
| mcf/d | thousand standard cu ft per day | $ft^3$/day |
| N | number of pressure buildup measurements per day | — |
| n | number of pound mols | — |
| n | number of wells producing into common facility | — |
| p | pressure | psia |
| Q | measurement index | — |
| R | universal gas constant | ft-lb/degR $lb_m$ |
| scf | standard cu ft | $ft^3$ |
| s | sampling (digitizing) frequency | hz |
| S | total gas metered and sold from battery | mcf |
| $T_{base}$ | time for sampling baseline pressure | sec |
| T, $T_b$ | gas temperature at gas/liquid interface | deg R |
| $T_i$ | tubing gas produced by well i | mcf |
| $T_{rt}$ | round trip time of pressure wave | sec |
| $T_{samp}$ | sampling (digitizing) time | sec |
| t | time | sec |
| U | total gas used for utilitarian purposes | mcf |
| $U_i$ | gas used for utilitarian purposes for well i | mcf |
| V | gas volume, also mol volume | $ft^3$ |
| v | speed of sound in gas (also wave speed) | ft/sec |
| z | compressibility factor | — |
| Δf | frequency increment | hz |
| $\nabla_t$ | geothermal gradient | deg F./100 ft |

What is claimed is:

1. A method of determining a fluid level in a space in a well utilizing a conduit in gaseous communication with the space in the well, a valve controlling gaseous communication through the conduit, and a downstream surge space for inrush, the conduit, the valve, and the surge space forming a closed system substantially sealed from the atmosphere, comprising:

determining ambient pressure in the conduit with the valve open and gas being produced in the space by the well;

closing the valve to cause gas pressure within the conduit to increase a selected amount above the ambient pressure;

opening the valve for a selected time interval and then re-closing the valve to cause the conduit and the surge space to be in gaseous communication for the selected time interval to create a rarefaction wave in the conduit and in the well without substantially venting gas into the atmosphere, wherein the rarefaction wave is created within the closed system by energy from the well itself without application of mechanical force by an external apparatus;

taking a plurality of conduit pressure measurements for a selected time, the time selected to allow the rarefaction wave to travel at a previously determined speed to a fluid top within the space in the well and then return to the surface;

evaluating the plurality of pressure measurements to determine a round-trip time for the rarefaction wave to travel to the fluid top and return to the surface, the round-trip time being the time difference between initiation of the wave and its return to the surface; and determining fluid level as half the product of wave speed and round-trip time.

2. The method of claim 1, wherein the conduit is in gaseous communication with a casing-tubing annulus of the well and the rarefaction wave is created in the casing-tubing annulus.

3. A method of determining fluid level in a space in a well utilizing a conduit in gaseous communication with the space, a first valve controlling gaseous communication through the conduit, and a storage chamber upstream of the first valve in selective gaseous communication with the conduit through a second valve, the conduit, the first valve, the storage chamber, and the second valve forming a closed system substantially sealed from the atmosphere, comprising:

isolating the storage chamber from the conduit with the second valve closed;

determining ambient pressure in the conduit with the first valve open and with gas being produced by the well;

opening the second valve to allow gaseous communication between the storage chamber and the conduit;

closing the first valve to cause gas pressure within the conduit to increase to a selected value above ambient pressure;

closing the second valve to trap higher pressure gas in the storage chamber;

opening the first valve to allow pressure in the conduit to return to the ambient value;

closing the first valve;

opening the second valve to cause the conduit and the storage chamber to be in gaseous communication for a time interval to create a compression wave in the conduit and the space in the well without substantially venting gas into the atmosphere, wherein the compression wave is created within the closed system by energy from the well itself without application of mechanical force by an external apparatus;

taking a plurality of conduit pressure measurements for a selected time, the time selected to allow the compression wave to travel at a previously determined speed to a fluid top within the space in the well and then return to the surface;

evaluating the plurality of pressure measurements to determine a round-trip time for the compression wave to travel to the fluid top and return to the surface, the round-trip time being the time difference between initiation of the wave and its return to the surface; and determining fluid level as half the product of wave speed and round-trip time.

4. The method of claim 1 or 3, wherein the method is performed without injecting a substance into the space to create a sound wave to determine the fluid level.

5. The method of claim 1 or 3, wherein the method is performed without releasing gas to the atmosphere from the space to create a sound wave to determine the fluid level.

6. A method of determining a fluid level in a well space with a closed measurement system without substantial venting of gas to the atmosphere or injecting a gas at high pressure, comprising:

creating an overpressure between first and second spaces with gas being produced by the well, the first and second spaces forming a portion of a closed system sealed from the atmosphere;

inducing a wave in the well space by causing the first and second spaces to come into gaseous communication for a selected time interval without venting gas into the atmosphere, wherein the induced wave makes a round-trip through the gas in the well space from the measurement system to a fluid surface and back to the measurement system, wherein the first space comprises the well space and the second space comprises a chamber disposed downstream of a valve controlling outlet of gas from the well space, wherein inducing the wave comprises:

closing the valve to increase the gas pressure within the well space while the chamber is at a lower gas pressure to create the overpressure between the well space and the chamber; and opening the valve for a selected time interval to cause gaseous communication between the well space and the chamber and then reclosing the valve to induce a rarefaction wave in the well space, wherein the rarefaction wave is created within the closed system by energy from the well itself without application of mechanical force by an external apparatus;

monitoring pressure changes with the measurement system as the wave makes the round-trip through the gas within the well space to determine a round-trip travel time for the wave; and determining the fluid level from the round-trip travel time and a speed of the wave through the gas within the well space.

7. A method of determining a fluid level in a well space with a closed measurement system without substantial venting of gas to the atmosphere or injecting a gas at high pressure, comprising:

creating an overpressure between first and second spaces with gas being produced by the well, the first and second spaces forming a portion of a closed system sealed from the atmosphere;

inducing a wave in the well space by causing the first and second spaces at to come into gaseous communication for a selected time interval without venting gas into the atmosphere, wherein the induced wave makes a round-trip through the gas in the well space from the measurement system to a fluid surface and back to the measurement system, wherein the first space comprises the well space and the second space comprises a chamber disposed upstream of a first valve controlling outlet of gas from the well space and a second valve controlling gaseous communications between the well space and the chamber, wherein inducing the wave comprises:

closing the first valve and opening the second valve to the chamber to increase gas pressure within the well space and the chamber;

closing the second valve to isolate the chamber;

opening the first valve to reduce the gas pressure within the well space and thereby create the overpressure between the well space and the chamber; and closing the first valve and opening the second valve to create a compression wave in the well space, wherein the compression wave is created within the closed system by energy from the well itself without application of mechanical force by an external apparatus;

monitoring pressure changes with the measurement system as the wave makes the round-trip through the gas within the well space to determine a round-trip travel time for the wave; and determining the fluid level from the round-trip travel time and a speed of the wave through the gas within the well space.

8. The method of claim 6 or 7, wherein the speed of the wave is predetermined based on constituents of the gas within the well.

9. The method of claim 6 or 7, further comprising determining the speed of the wave by:

inducing a second wave in gas within a resonance tube in gaseous communication with the well space;

taking digitized pressure measurements of the gas within the resonance tube for a time interval sufficient to determine the frequency of the second wave within the resonance tube;

determining the frequency of the second wave in the resonance tube from a Fast Fourier Transform (FFT) magnitude versus frequency spectrum; and computing speed of the induced wave in the well space as a selected multiple of the product of the frequency of the second wave in the resonating tube times a length of the resonating tube.

10. The method of claim 9, wherein the resonance tube has a first end in gaseous communication with the well space and a closed second end and computing the speed of the wave in the well space comprises computing the wave speed in the well space as four times the product of the frequency of the second wave in the resonating tube times the length of the resonating tube.

11. The method of claim 10, wherein the first end of the resonating tube is in controlled gaseous communication with the well space through an isolation valve, the method further comprising:

opening the isolation valve;

causing an increase in gas pressure in the well space and the resonating tube;

closing the isolation valve;

decreasing the pressure in the well space; and opening the isolating valve for a selected time period and then reclosing the isolation valve while taking gas pressure measurements in the resonating tube for a time sufficient to determine the frequency of the second wave within the resonating tube using the FFT.

12. The method of claim 9, wherein the resonance tube has first and second ends in gaseous communication with the well space and computing the speed of the wave in the well space comprises inducing the second wave in the resonance tube with the wave in the well space and computing the wave speed in the well space as two times the product of the frequency of the second wave in the resonating tube times a length of the resonating tube.

13. A method of determining a fluid level in a well space with a closed measurement system without substantial venting of gas to the atmosphere or injection of high pressure gas, comprising:

creating an overpressure between first and second spaces with gas being produced by the well, the first and second spaces forming a portion of a closed system substantially sealed from the atmosphere wherein the overpressure is created within the closed system by energy from the well itself without application of mechanical force by an external apparatus;

inducing a wave in the well space by causing the first and second spaces at to come into gaseous communication for a selected time interval without substantially venting gas into the atmosphere, wherein the induced wave makes a round-trip through the gas in the well space from the measurement system to a fluid surface and back to the measurement system;

monitoring pressure changes with the measurement system as the wave makes the round-trip through the gas within the well space to determine a round-trip travel time for the wave;

calculating a speed of the wave through the gas within the well space comprising:

inducing a second wave in gas within a resonance tube in gaseous communication with the well space;

measuring gas pressure within the resonance tube at selected time intervals;

determining the frequency of the second wave in the resonance tube using the measurements of gas pressure within the resonance tube;

computing the speed from the frequency of the second wave and a length of the resonating tube; and determining the fluid level as one-half of the distance traveled by the wave in the well space.

* * * * *